US008284187B2

(12) United States Patent
Yamashita et al.

(10) Patent No.: US 8,284,187 B2
(45) **Date of Patent: *Oct. 9, 2012**

(54) DISPLAY PANEL MODULE AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 520 days.

This patent is subject to a terminal disclaimer.

(21) Appl. No.: 12/458,705

(22) Filed: Jul. 21, 2009

(65) Prior Publication Data

US 2010/0033477 A1 Feb. 11, 2010

(30) Foreign Application Priority Data

Aug. 8, 2008 (JP) ..... 2008-205662

(51) Int. Cl.
*G09G 5/00* (2006.01)

(52) U.S. Cl. ..... 345/215; 345/210; 345/212

(58) Field of Classification Search ..... 345/76–82, 345/89–100, 204–215, 690; 315/169.1–169.4
See application file for complete search history.

(56) References Cited

U.S. PATENT DOCUMENTS 6,229,506 B1 * 5/2001 Dawson et al. ..... 345/82
6,229,508 B1 * 5/2001 Kane ..... 345/82
6,356,026 B1 * 3/2002 Murto ..... 315/111.81
6,693,388 B2 * 2/2004 Oomura ..... 315/169.3
2005/0206590 A1 9/2005 Sasaki et al.
2006/0170628 A1 8/2006 Yamashita et al.
2006/0176250 A1 8/2006 Nathan et al.

FOREIGN PATENT DOCUMENTS

| | | |
|---|---|---|
| JP | 2003-255897 | 9/2003 |
| JP | 2003-271095 | 9/2003 |
| JP | 2005-173434 | 6/2005 |
| JP | 2006-215213 | 8/2006 |
| JP | 2008-523425 T | 7/2008 |
| JP | 2008-286953 A | 11/2008 |
| JP | 2009-237425 A | 10/2009 |
| JP | 2009-294508 A | 12/2009 |
| JP | 2009-294635 A | 12/2009 |

OTHER PUBLICATIONS

Japanese Office Action issued Aug. 3, 2010 for corresponding Japanese Application No. 2008-205662.

* cited by examiner

*Primary Examiner* — Vijay Shankar
(74) *Attorney, Agent, or Firm* — Rader Fishman & Grauer, PLLC

(57) ABSTRACT

Disclosed herein is a self-light-emission-type display panel module including: a pixel array section including pixel areas laid out to form a 2-dimensional matrix in a display area to serve as pixel areas each having a signal holding capacitor, a device driving transistor, and a signal sampling transistor; and a third driving section configured to provide a second control line connected to the other main electrode of the device driving transistor sequentially from time to time with the three different driving voltages.

13 Claims, 34 Drawing Sheets

FIG.6A WSL

FIG.6B LSL

FIG.26A WSL

FIG.26B LSL

DISPLAY PANEL MODULE AND ELECTRONIC APPARATUS

BACKGROUND OF THE INVENTION

1. Field of the Invention

An invention described in this specification relates to a technology for driving a self-light-emitting device of a current-driven type. It is to be noted that an embodiment of the present invention is applied to a display panel module whereas another embodiment of the present invention is applied to a variety of electronic apparatus each employing the display panel module.

2. Description of the Related Art

The following description explains the structure of an organic EL (Electro Luminescence) panel module adopting an active matrix driving method as the structure of a typical display panel module and typical operations carried out by the organic EL panel module.

FIG. 1 is an explanatory block diagram showing a typical system structure of the organic EL panel module serving as a typical display panel module 1. As shown in the block diagram, the display panel module 1 employs a pixel array section 3, a signal-line driving section 5, a first control-line driving section 7 and a second control-line driving section 9. Each of the signal-line driving section 5, the first control-line driving section 7 and the second control-line driving section 9 is a circuit for driving the pixel array section 3.

In the pixel array section 3, each of pixels serves as a white unit. The pixels are laid out on the screen, which is formed by the pixel array section 3, to form a 2-dimensional matrix at resolutions prescribed in the vertical and horizontal directions.

FIG. 2 is an explanatory block diagram showing the configuration of a pixel which includes an array of sub-pixels 11 to serve as a white unit as described above. In the case of the configuration shown in the block diagram of FIG. 2, the pixel is configured to serve as a set which has an R (red color) sub-pixel 11, a G (green color) sub-pixel 11 and a B (blue color) sub-pixel 11. The number of sub-pixels 11 laid out on the pixel array section 3 is thus M×N×3 where reference notation N denotes the number of sub-pixels laid out on each row of the 2-dimensional matrix whereas reference notation M denotes the number of such rows laid out to form the 2-dimensional matrix. That is to say, the integer M represents the vertical-direction (or Y-direction) resolution whereas the integer N represents the horizontal-direction (or X-direction) resolution.

FIG. 1 shows interconnections between the circuits for driving the pixel array section 3 and the sub-pixels 11 which each serve as a smallest unit of the structure of each of the pixels composing the pixel array section 3.

The signal-line driving section 5 is a driving circuit for asserting a signal electric potential Vsig representing pixel data Din on a data signal line DTL. Each of the signal lines DTL is stretched in the vertical direction (or the Y direction). On the screen formed by the pixel array section 3, 3N signal lines DTL are laid out in the horizontal direction (or the X direction).

The first control-line driving section 7 is a driving circuit for driving write control signal lines WSL in order to sequentially control operations to write the signal electric potential Vsig or the like into sub-pixels 11 on a line-after-line basis. In claims of this specification, the write control signal line WSL is referred to as a first control line. In the case of the display panel module 1 shown in the block diagram of FIG. 1, the first control-line driving section 7 sequentially carries out operations for each horizontal line unit (or each row of the 2-dimensional matrix) on a line-after-line basis in order to specify timings to write the signal electric potentials Vsig and offset electric potentials Vofs into sub-pixels 11.

The second control-line driving section 9 is a driving circuit for controlling switching from an operation to supply a driving power to sub-pixels 11 through lighting control signal lines LSL to an operation to supply no driving power to sub-pixels 11 and vice versa. In claims of this specification, the lighting control signal line LSL is referred to as a second control line. To put it more concretely, the second control-line driving section 9 asserts a driving electric potential Vcc or a ground electric potential Vss on the lighting control signal lines LSL. The driving electric potential Vcc is also referred to as a light emission electric potential whereas the ground electric potential Vss is referred to as a no-light emission electric potential.

In the case of the display panel module 1 shown in the block diagram of FIG. 1, each of the write control signal lines WSL and the lighting control signal lines LSL is stretched in the X direction (or the horizontal direction). 3M write control signal lines WSL are laid out in the Y direction (or the vertical direction). By the same token, 3M lighting control signal lines LSL are also laid out in the Y direction (or the vertical direction) as well.

FIG. 3 is an explanatory circuit diagram showing the structure of a sub-pixel 11. As shown in the circuit diagram of FIG. 3, the sub-pixel 11 employs a signal sampling transistor N1, a device driving transistor N2, a signal holding capacitor Cs and an organic EL device OLED. Each of the signal sampling transistor N1 and the device driving transistor N2 is a thin film transistor. The signal holding capacitor Cs is a capacitor for holding the signal electric potential Vsig supplied by the data signal line DTL.

One of the two main electrodes of the signal sampling transistor N1 is connected to the data signal line DTL whereas the other main electrode of the signal sampling transistor N1 is connected the control electrode of the device driving transistor N2. The control electrode of the signal sampling transistor N1 is connected to the write control signal line WSL.

One of the two main electrodes of the device driving transistor N2 is connected to the lighting control signal line LSL whereas the other main electrode of the device driving transistor N2 is connected the anode of the organic EL device OLED.

It is to be noted that, in the case of the sub-pixel 11 shown in the circuit diagram of FIG. 3, each of the signal sampling transistor N1 and the device driving transistor N2 is a thin-film transistor of the N-channel type. The circuit diagram of FIG. 3 also shows capacitors Coled and Csub each drawn by making use of a dashed line. The device capacitor Coled represents the capacitance of the organic EL device OLED whereas the parasitic capacitor Csub is a parasitic capacitor which exists between the device capacitor Coled and a substrate.

Patent Document 1:

Japanese Patent Laid-Open No. 2003-271095

Patent Document 2:

Japanese Patent Laid-Open No. 2003-255897

Patent Document 3:

Japanese Patent Laid-Open No. 2005-173434

Patent Document 4:

Japanese Patent Laid-Open No. 2006-215213

SUMMARY OF THE INVENTION

FIGS. 4A to 4E show explanatory timing charts of operations to drive the sub-pixel 11 described above. To be more specific, FIG. 4A is a timing chart showing a waveform representing changes of a driving signal appearing on the write control signal line WSL whereas FIG. 4B is a timing chart showing a waveform representing changes of a driving signal appearing on the data signal line DTL. FIG. 4C is a timing chart showing a waveform representing changes of a driving signal appearing on the lighting control signal line LSL whereas FIG. 4D is a timing chart showing a waveform representing changes of a gate electric potential Vg appearing at the gate electrode of the device driving transistor N2. FIG. 4E is a timing chart showing a waveform representing changes of a source electric potential Vs appearing at the source electrode of the device driving transistor N2. In this case, the source electric potential Vs appearing at the source electrode of the device driving transistor N2 is an electric potential appearing at the main electrode which pertains to the device driving transistor N2 to serve as the source electrode at a light emission time.

As shown in the timing charts of FIGS. 4A to 4E, the operations to drive the sub-pixel 11 are carried out during a light emission period and a no-light emission period. The operation to store a signal electric potential Vsig in the signal holding capacitor Cs is started in the no-light emission period. If the thin-film transistors N1 and N2 are created by carrying out a low-temperature poly-silicon process and/or an amorphous silicon process, however, the transistors exhibit variations of the threshold-voltage characteristic and the mobility characteristic. That is to say, the threshold-voltage characteristic and the mobility characteristic vary from transistor to transistor.

In order to compensate the device driving transistor N2 for the characteristic variations described above, a horizontal scan period denoted by reference notation 1H in the timing charts of FIGS. 4A to 4E is set to include two operation periods provided for compensating the device driving transistor N2 for the characteristic variations described above. That is to say, the no-light emission period denoted by reference notation 1H includes two periods in each of which the write control signal line WSL is set at an H (high) level.

In the first period during which the write control signal line WSL is set at the H level, a threshold-voltage compensation process is carried out whereas, in the second period during which the write control signal line WSL is set at the H level, on the other hand, a mobility compensation process is carried out. It is to be noted that, prior to the execution of the threshold-voltage compensation process, an initialization operation is carried out in order to increase a gate-source voltage Vgs appearing between the gate and source electrodes of the device driving transistor N2 to a magnitude at least equal to the threshold voltage Vth of the device driving transistor N2. In order to carry out this initialization operation, the lighting control signal line LSL is controlled to temporarily decrease to an L (low) level which is the level of the ground electric potential Vss cited before. At a point of time at which the initialization operation is completed, the gate-source voltage Vgs of the device driving transistor N2 has a magnitude at least equal to the threshold voltage Vth of the device driving transistor N2. Thus, when the lighting control signal line LSL is controlled to increase to an H (high) level which is the level of the driving electric potential Vcc, a driving current Ids starts to flow to the device driving transistor N2, starting to raise the source electric potential Vs appearing at the source electrode of the device driving transistor N2.

Prior to the end of the initialization operation, the gate electric potential Vg appearing at the gate electrode of the device driving transistor N2 has been fixed at the offset electric potential Vofs. The source electric potential Vs of the device driving transistor N2 continues to rise till the gate-source voltage Vgs of the device driving transistor N2 is reduced to the threshold voltage Vth. This is because, as the gate-source voltage Vgs of the device driving transistor N2 is reduced to the threshold voltage Vth of the device driving transistor N2, the device driving transistor N2 is automatically turned off. The operation is referred to as the threshold-voltage compensation process.

As described above, in the second period during which the write control signal line WSL is set at the H level, a mobility compensation process is carried out. It is to be noted that, during the execution of the mobility compensation process, an operation to store the signal electric potential Vsig in the signal holding capacitor Cs is also carried out as well at the same time.

The mobility compensation process is carried out by putting the signal sampling transistor N1 in a turned-on state after the signal electric potential Vsig has been asserted on the data signal line DTL. It is to be noted that the mobility μ represents the current generating capability of the device driving transistor N2. A device driving transistor N2 having a relatively large mobility μ is capable of generating a driving current Ids greater than a driving current Ids generated by a device driving transistor N2 having a relatively small mobility μ even if the gate-source voltage Vgs of the driving transistor N2 having a relatively large mobility μ is set at a magnitude equal to the gate-source voltage Vgs of the driving transistor N2 having a relatively small mobility μ. For this reason, the mobility compensation process is carried out in order to compensate the device driving transistor N2 for the mobility μ which varies from transistor to transistor, causing the driving current Ids to also vary from transistor to transistor. The gate-source voltage Vgs of a device driving transistor N2 is reduced due to the increase of the source electric potential Vs of the device driving transistor N2 by such an electric-potential decrease that the larger the mobility μ of the device driving transistor N2, the larger the electric-potential decrease. Thus, without regard to differences in mobility μ, any device driving transistor N2 having a relatively large mobility μ generates a driving current Ids equal to a driving current Ids generated by a device driving transistor N2 having a relatively small mobility μ provided that the gate-source voltage Vgs of the driving transistor N2 having a relatively large mobility μ is set at a magnitude equal to the gate-source voltage Vgs of the driving transistor N2 having a relatively small mobility μ, that is, provided that the same signal electric potential Vsig is applied to the gate electrodes of the driving transistors N2.

By the way, the length of the time t that it takes to properly carry out the mobility compensation process varies in accordance with the magnitude of the signal electric potential Vsig.

In general, the magnitude of the driving current Ids flowing in the course of the mobility compensation process is expressed by Eq. (1) given as follows:

$$Ids=k\cdot\mu\cdot\{Vsig/[1+(Vsig\cdot k\cdot\mu\cdot t)/C]\}^2 \quad (1)$$

In Eq. (1) given above, reference notation k denotes a constant whereas reference notation C denotes the total capacitance of the pixel circuit. That is to say, reference notation C denotes a capacitance expressed by the following equation:

$$C=Cs+Coled+Csub$$

The optimum length of the time t that it takes to carry out the mobility compensation process is expressed by Eq. (2) given as follows:

$$t=C/(k\cdot\mu\sim Vsig) \quad (2)$$

Eq. (2) is substituted into Eq. (1) to serve as a replacement for the time t in order to find a driving current Ids for the optimized length of the time t. The driving current Ids for the optimized length of the time t is thus expressed by Eq. (3) given as follows:

$$Ids=k\cdot\mu\cdot\{Vsig/2\}^2 \quad (3)$$

Eq. (3) means that the optimum mobility compensation time found by calculation in accordance with Eq. (2) is the time that it takes to raise the gate-source voltage Vgs by an electric-potential increase equal to half the signal electric potential Vsig. In other words, Eq. (3) implies that, the gate-source voltage Vgs is raised by a mobility-compensation voltage ΔV which is equal to half the signal electric potential Vsig.

FIG. 5 is an explanatory diagram showing relations between a mobility-compensation voltage ΔV and a mobility compensation time that it takes to obtain the mobility-compensation voltage ΔV for different magnitudes of the signal electric potential Vsig. A bold-line curve shown in the diagram of FIG. 5 represents a relation between an optimum mobility compensation time period t and the mobility-compensation voltage ΔV when the mobility compensation process is carried out.

The timing of the falling edge of the second H-level period shown in the timing chart of FIG. 4A is adjusted properly to change in accordance with the bold-line curve shown in the diagram of FIG. 5 so that the mobility compensation process can be carried out during a proper mobility compensation period to result in neither insufficient compensation nor excessive compensation for every magnitude of the signal electric potential Vsig.

FIGS. 6A to 6D show typical examples of the explanatory timing charts for the mobility compensation process. The timing charts of FIGS. 6A to 6D represent waveforms for a signal electric potential Vsig of 4 V. To be more specific, FIG. 6A is a timing chart showing a waveform representing changes of the driving signal appearing on the write control signal line WSL whereas FIG. 6B is a timing chart showing a waveform representing changes of the driving signal appearing on the lighting control signal line LSL. FIG. 6C is a timing chart showing a waveform representing changes of the gate electric potential Vg appearing at the gate electrode of the device driving transistor N2 whereas FIG. 6D is a timing chart showing a waveform representing changes of the source electric potential Vs appearing at the source electrode of the device driving transistor N2.

As shown in the timing chart of FIG. 6D, during the mobility compensation period t, the gate electric potential Vg of the device driving transistor N2 rises by 2 V. Accordingly, the gate-source voltage Vgs of the device driving transistor N2 becomes equal to 4 V+Vth−2 V=2 V+Vth.

By carrying out the threshold-voltage compensation process and the optimized mobility compensation process, the device driving transistor N2 can be compensated for variations in threshold voltage from transistor to transistor and variations in mobility from transistor to transistor. As a result, it is possible to prevent the characteristic variations of the device driving transistor N2 from being recognized as differences in emitted-light luminance.

However, the method for driving the pixel circuit shown also raises a problem that needs to be solved. This problem is caused by the fact that, the larger the magnitude of the signal electric potential Vsig, the smaller the magnitude to which the mobility compensation time t must be shortened as is obvious from Eq. (2).

Of course, the need to shorten the mobility compensation time t to a small magnitude in inverse proportion to the magnitude of the signal electric potential Vsig is not a problem by itself. However, the contemporary display panel is demanded to be capable of displaying an image having a higher quality so that it is necessary to further raise the luminance or further increase the contrast ratio. In order to raise the luminance, it is necessary to raise the magnitude of the signal electric potential Vsig.

As described above, if the magnitude of the signal electric potential Vsig is increased, however, the mobility compensation time t must be further shortened. With the mobility compensation time t further shortened, time variations of the driving signal appearing on the write control signal line WSL cannot be ignored and stripe clusters or the like are generated with ease on the display screen. The time variations of the driving signal are variations in compensation time. That is to say, the increased luminance worsens the uniformity and the worsened uniformity causes a poor image quality.

Addressing the problems described above, inventors of the present invention have innovated a self-light-emission-type display panel module employing:

(a): a pixel array section including pixel areas laid out to form a 2-dimensional matrix in a display area to serve as pixel areas each including:

a signal holding capacitor;

a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor; and a signal sampling transistor for controlling an operation to supply a signal electric potential to the control electrode of the device driving transistor;

(b): a first driving section configured to assert the signal electric potential on a data signal line;

(c): a second driving section configured to assert an electric-potential write timing signal on a first control line connected to the control electrode of the signal sampling transistor; and (d): a third driving section configured to provide a second control line connected to the other main electrode of the device driving transistor sequentially from time to time with the following three different driving voltages:

a first driving voltage having a lowest electric potential during a time span between the start of a no-light emission period and the start of a period for compensating the device driving transistor for characteristic variations;

a second driving voltage having an intermediate electric potential during a time span between the start of the period for compensating the device driving transistor and an initial time of a light emission period; and a third driving voltage having a highest electric potential after the initial time of the light emission period.

In addition, addressing the problems described above, the inventors of the present invention have innovated a self-light-emission-type display panel module employing:

(a): a pixel array section including pixel areas laid out to form a 2-dimensional matrix in a display area to serve as pixel areas each including:

a signal holding capacitor;

a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor;

a signal sampling transistor for controlling an operation to supply a signal electric potential to the control electrode of the device driving transistor; and a coupling capacitor having a specific electrode connected to the control electrode of the device driving transistor and the other electrode connected to a third control line;

(b): a first driving section configured to assert the signal electric potential on a data signal line;

(c): a second driving section configured to assert an electric-potential write timing signal on a first control line connected to the control electrode of the signal sampling transistor;

(d): a third driving section configured to provide a second control line connected to the other main electrode of the device driving transistor sequentially from time to time with the following two different driving voltages:

a first driving voltage having a relatively low electric potential during a time span between the start of a no-light emission period and the start of a period for compensating the device driving transistor for characteristic variations; and a second driving voltage having a relatively high electric potential after the start of the period for compensating the device driving transistor; and (e): a fourth driving section configured to provide the third control line connected to the other electrode of the coupling capacitor sequentially from time to time with the following two different driving voltages:

a low-level driving voltage having a relatively low electric potential during a time span between the start of the no-light emission period and an initial time of a light emission period; and a high-level driving voltage having a relatively high electric potential after the initial time of the light emission period.

In addition, it is desirable to let the second driving section set an electric-potential application period T for a pixel gradation at a value larger than the length t of the mobility compensation time. In particular, in the case of high luminance levels, it is desired to provide a driving state in which the electric-potential application period T and the length t of the mobility compensation time satisfy the following relation T>t. As described above, the length t of the mobility compensation time is expressed by Eq. (2) as follows:

$$t=C/(k\cdot\mu\cdot Vsig)$$

In the above equation, reference notation k denotes a constant, reference notation μ denotes the mobility of a thin-film transistor and reference notation Vsig denotes a signal electric potential corresponding to the pixel gradation.

By the way, the self-light-emission-type display panel module explained above can also be described as a display panel module employing:

(a): a pixel array section including pixel areas laid out to form a 2-dimensional matrix in a display area to serve as pixel areas each including at least:

a signal holding capacitor;

a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor; and a signal sampling transistor for controlling an operation to supply a signal electric potential to the control electrode of the device driving transistor;

(b): a first driving section configured to assert the signal electric potential on a data signal line;

(c): a second driving section configured to assert an electric-potential write timing signal on a first control line connected to the control electrode of the signal sampling transistor; and (d): a third driving section configured to increase an electric potential appearing at the control electrode of the device driving transistor through a coupling effect exercised after an initial time of a light emission period.

In addition, the inventors of the present invention have also innovated an electronic apparatus including the self-light-emission-type display panel module employing the sections described above.

The electronic apparatus is configured to employ the display panel module, a system control section and an operation input section. The system control section is a section for controlling operations carried out in the entire electronic apparatus. The operation input section is a section for receiving operation inputs entered by the user to the system control section.

In the case of an invention innovated by the inventors of the present invention, a third driving section increases an electric potential appearing at the control electrode of the device driving transistor through a coupling effect exercised after the start of a light emission period in order to optimize the gate-source voltage of the device driving transistor. That is to say, through the coupling effect exhibited after the start of a light emission period, it is possible to implement electric-potential relations as if a signal electric potential higher than a signal electric potential actually applied to the data signal line were supplied to the data signal line.

By adopting the driving method described above, it is possible to lower a signal electric potential actually applied to the data signal line during the mobility compensation period to a level lower than a signal electric potential required to obtain an eventual electric-potential relation by a difference equal to a voltage added through the coupling effect. By lowering the signal electric potential actually applied to the data signal line, the length of time allocated to the mobility compensation process can be raised by an increase corresponding to the decrease in actually applied signal electric potential.

As a result, while being oriented to high-luminance displays, it is possible to implement a self-light-emission type display panel capable of assuring sufficient mobility compensation time and capable of displaying an image with a high quality, In addition, the mobility compensation time is determined in order to implement a mobility-compensation voltage for a signal electric potential required to obtain eventual electric-potential relations. In this case, the mobility-compensation voltage for the signal electric potential required to obtain the eventual electric-potential relations is higher than a mobility-compensation voltage for the actually applied signal electric potential.

That is to say, the mobility compensation time is shifted in a direction in which the length of the mobility compensation time is increased. By shifting the mobility compensation time in such a direction, even in the case of larger values of the luminance, it is possible to assure mobility compensation time with a length equal to or greater than a value determined in advance. By assuring mobility compensation time with a length equal to or greater than a value determined in advance, it is possible to reduce effects of variations in mobility compensation time so that uniformity can be enhanced.

BRIEF DESCRIPTION OF THE DRAWINGS

These and other innovations as well features of the present invention will become clear from the following description of the preferred embodiments given with reference to the accompanying diagrams, in which.

DETAILED DESCRIPTION OF THE PREFERRED EMBODIMENTS

The following description explains a case in which the present invention is applied to an organic EL panel module of an active matrix driving type. It is to be noted that, to embodiment members neither described in this specification nor shown in diagrams included in the specification, it is possible to apply technologies commonly known in the same fields as the members and/or technologies disclosed to the public as technologies pertaining to the same fields as the members. In addition, preferred embodiments described below are merely typical implementations of the present invention. That is to say, implementations of the present invention are by no means limited to the preferred embodiments.

(A): External Configuration

The technical term 'display panel module' used in this specification means not only a display panel module employing a pixel array section and driving circuits created on the same substrate as the pixel array section by carrying out semiconductor processes, but also other display panel modules such as a display panel module employing a pixel array section and driving circuits each created to serve as an ASIC (Application-Specific Integrated Circuit) on the same substrate as the pixel array section.

Figure 7:
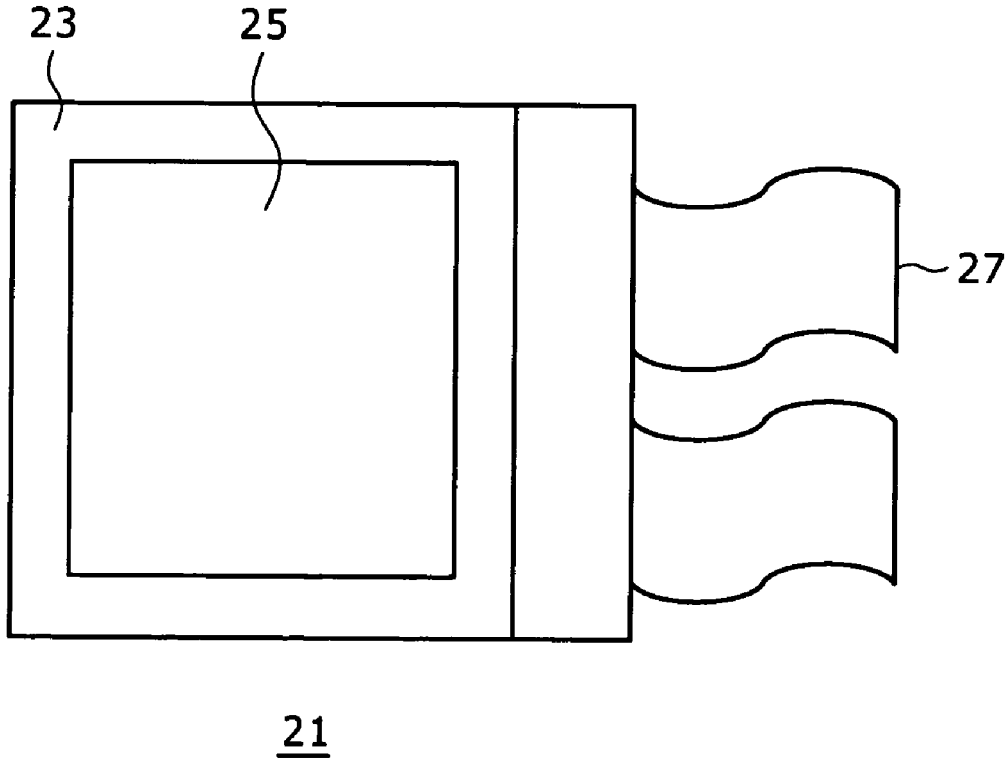
FIG. 7 is a diagram showing a typical external configuration of an organic EL panel module.

FIG. 7 is a diagram showing a typical external configuration of the organic EL panel module 21. As shown in the figure, the organic EL panel module 21 has a structure in which a facing substrate 25 is pasted on a display area of a support substrate 23. The support substrate 23 is made of a base material such as glass or plastic. The facing substrate 25 is also made of a transparent base material such as glass or plastic.

The base material of the facing substrate 25 seals the surface of the support substrate 23, sandwiching a sealing material between the base material of the facing substrate 25 and the surface. It is to be noted that the transparency of the base material of the facing substrate 25 needs to be assured merely on the radiation side of light. That is to say, on other sides, the base material of the facing substrate 25 can be nontransparent. In addition, the organic EL panel module 21 is also provided with an FPC (Flexible Print Circuit) 27 for receiving external signals and a driving power.

(B): First Embodiment (B-1): System Configuration

Figure 1:
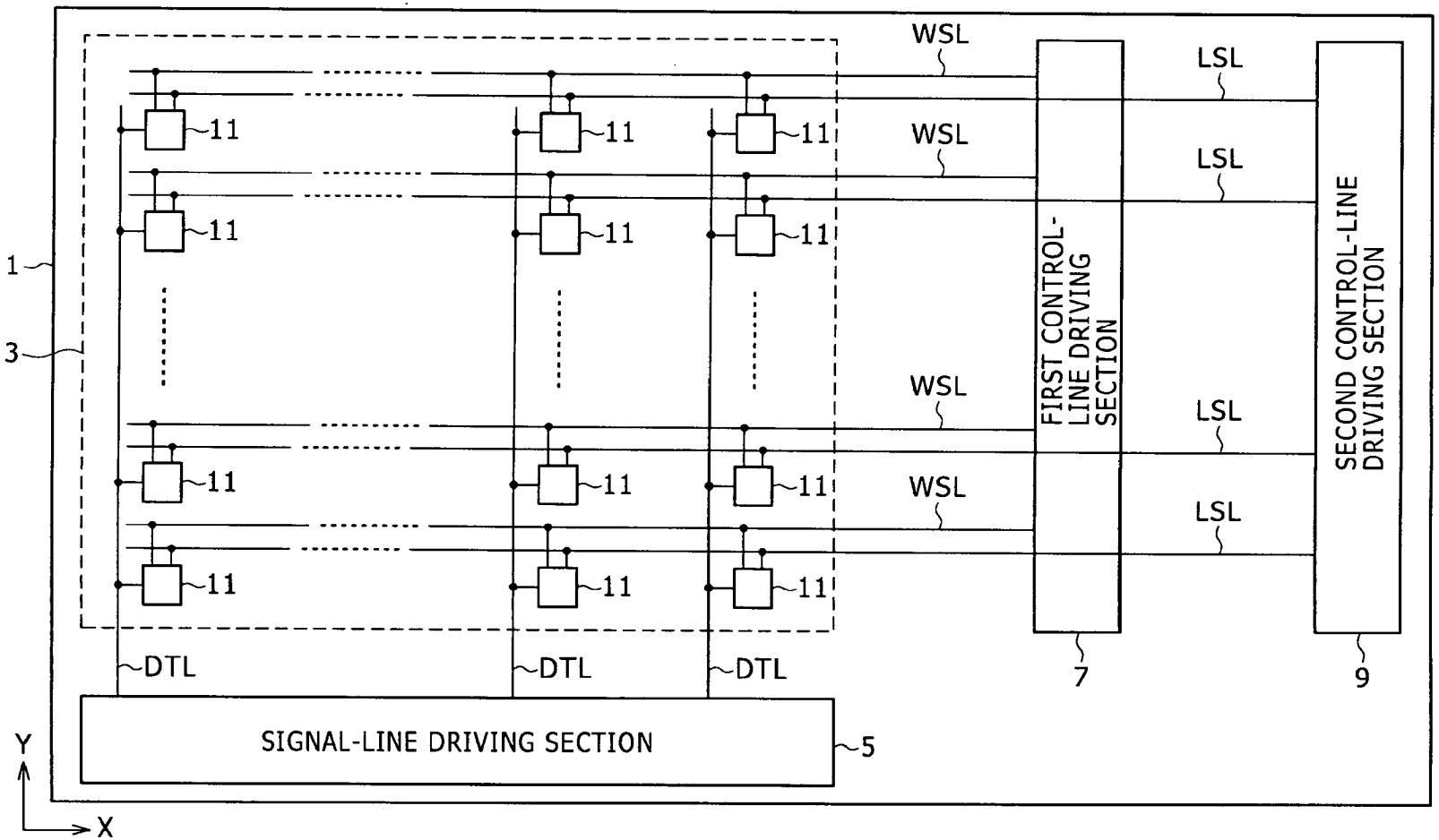
FIG. 1 RELATED ART
FIG. 1 is an explanatory block diagram showing a typical system structure of an organic EL panel module serving as a typical display panel module.
Figure 2:
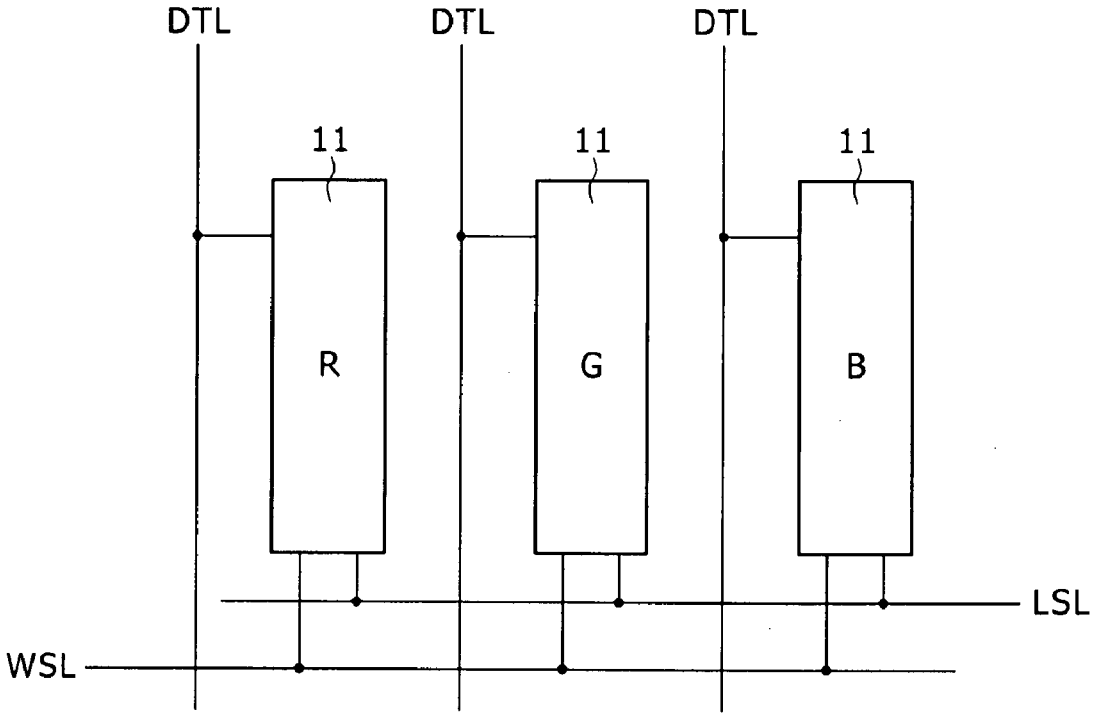
FIG. 2 RELATED ART
FIG. 2 is an explanatory block diagram showing the configuration of a pixel which includes an array of sub-pixels.
Figure 8:
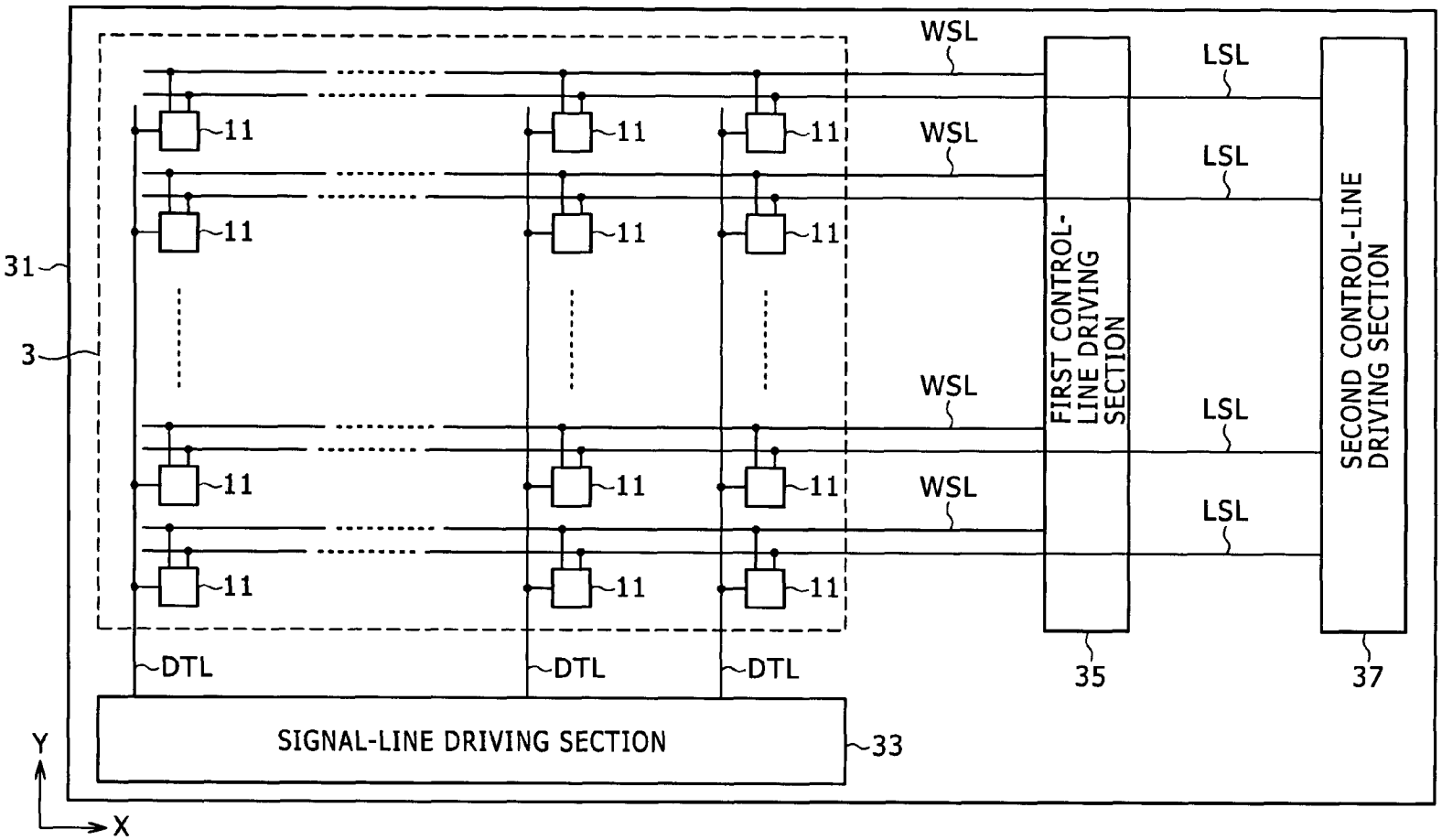
FIG. 8 is a block diagram showing a typical system configuration of an organic EL panel module according to a first embodiment.

FIG. 8 is a block diagram showing a typical system configuration of an organic EL panel module 31 according to a first embodiment. In the block diagram of FIG. 8, components identical with their respective counterparts shown in the block diagram of FIG. 1 are denoted by the same reference numerals or the same reference notations as the counterparts.

The organic EL panel module 31 shown in the block diagram of FIG. 8 employs a pixel array section 3, a signal-line driving section 33, a first control-line driving section 35 and a second control-line driving section 37. Each of the signal-line driving section 33, the first control-line driving section 35 and the second control-line driving section 37 is a circuit for driving the pixel array section 3.

The following description explains the configurations of the driving circuits as configurations peculiar to the first embodiment.

(a): Configuration of the Signal-Line Driving Section

The signal-line driving section 33 is a driving circuit for asserting the signal electric potential Vsig on the data signal line DTL to represent pixel data Din.

Figure 9:
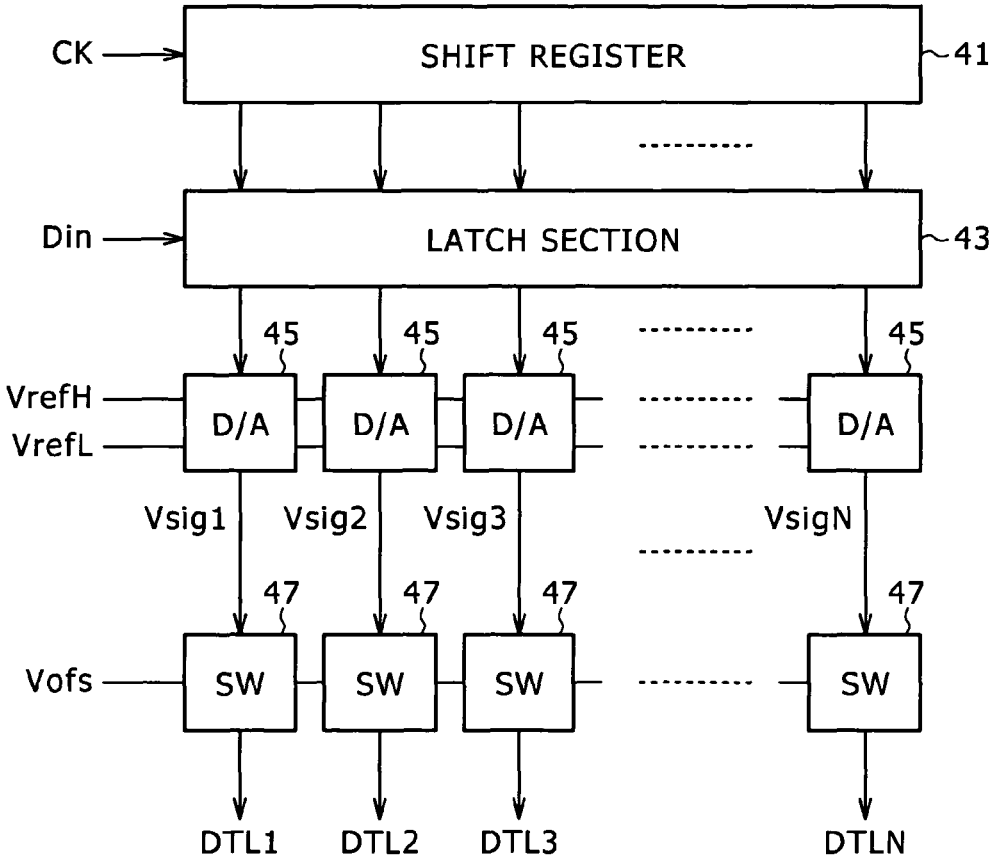
FIG. 9 is a diagram showing a typical configuration of a signal-line driving section.

FIG. 9 is a diagram showing a typical internal configuration of the signal-line driving section 33. As shown in the figure, the signal-line driving section 33 employs a shift register 41, a latch section 43, digital-to-analog conversion circuits 45 and switches 47. The shift register 41 is a circuit for generating signals indicating timings to latch pixel data Din in the latch section 43 on the basis of a clock signal CK.

The latch section 43 is a storage device for storing pixel data Din in a storage area allocated to the pixel data Din on the basis of timing signals generated by the shift register 41.

The digital-to-analog conversion circuit 45 is a circuit for converting pixel data Din latched in the latch section 43 into an analog signal voltage used as the signal electric potential Vsig. It is to be noted that the conversion characteristic of the digital-to-analog conversion circuit 45 is determined by an H-level reference electric potential VrefH and an L-level reference electric potential VrefL.

The first embodiment adopts a driving method for raising the gate electric potential Vg of the device driving transistor N2 through a coupling effect exercised after the start of a light emission period as will be described later.

That is to say, the digital-to-analog conversion circuit 45 is a conversion circuit capable of generating a signal electric potential Vsig with a magnitude adjusted to a value smaller than a signal amplitude assumed at a light emission operation time by a difference corresponding to an electric-potential increase made at the subsequent stage. To put it more concretely, the H-level reference electric potential VrefH is set at an electric potential lower than the signal amplitude realized after the coupling effect by a difference corresponding to a coupling voltage.

Figure 10:
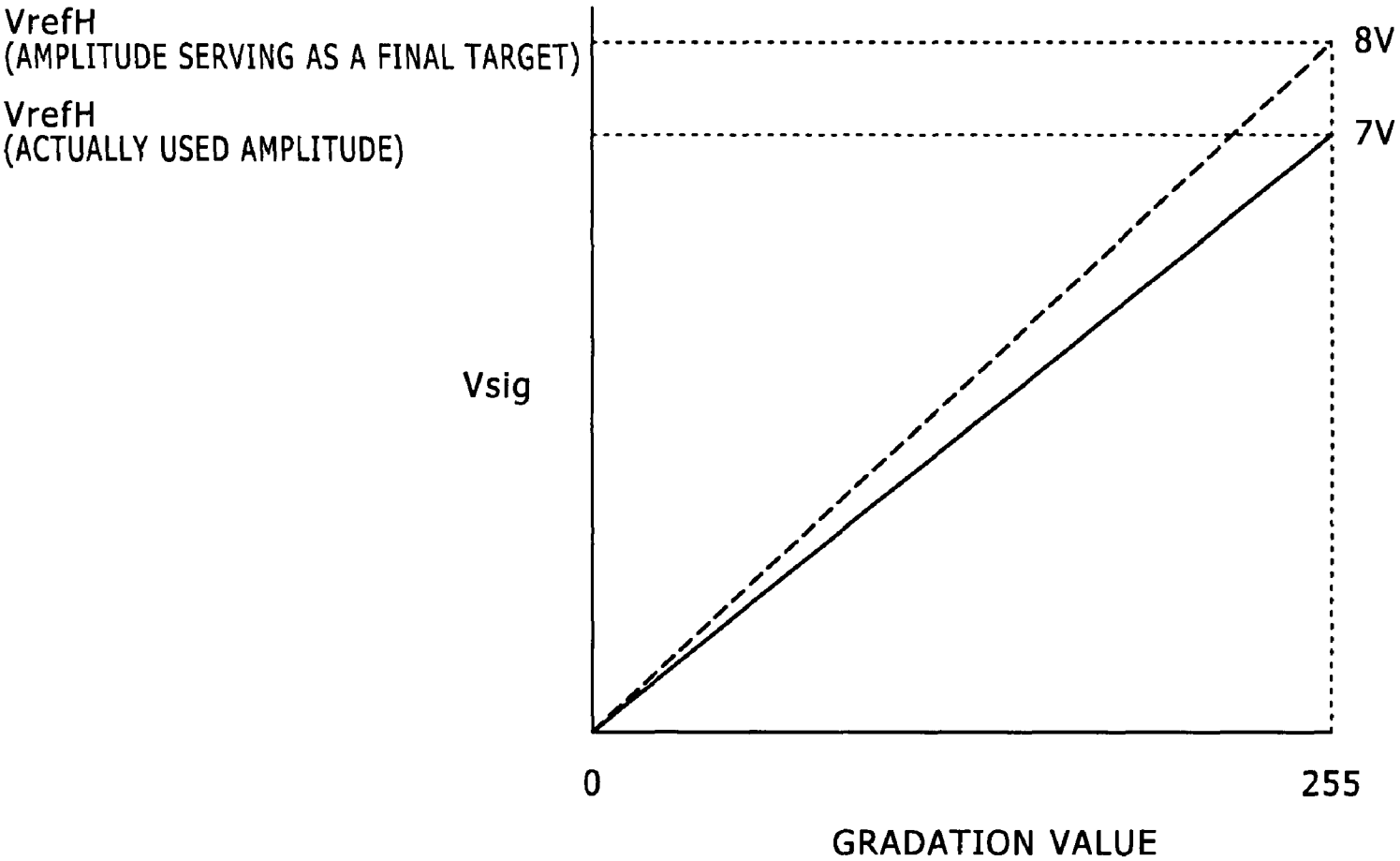
FIG. 10 is an explanatory diagram showing a relation between a solid line representing an input/output characteristic adopted in the first embodiment virtually exercising a coupling effect and a dashed line representing a desired input/output characteristic.

FIG. 10 is an explanatory diagram showing a relation between a solid line representing an input/output characteristic adopted in the first embodiment virtually exercising a coupling effect and a dashed line representing a desired input/output characteristic. In the case of the first embodiment, the digital-to-analog conversion circuit 45 carries out such a digital-to-analog conversion process that the signal amplitude of the signal electric potential Vsig is smaller than an eventually desired signal amplitude of 8 V by a difference of 1 V.

In this way, the signal amplitude of the signal electric potential Vsig applied to the data signal line DTL is made smaller than the eventually desired signal amplitude. As a result, the mobility compensation time required for carrying out the mobility compensation process can be shifted in a direction in which the length of the mobility compensation time is increased to a value greater than the length of the mobility compensation time for a case the coupling effect is not exercised.

The switch 47 is a circuit for selecting the signal electric potential Vsig corresponding to the pixel gradation or the offset electric potential Vofs used for the mobility compensation process and for supplying the selected one to a data signal line DTL provided for the selected one. To put it more concretely, the switch 47 outputs the signal electric potential Vsig only during a period in which an operation to store the signal electric potential Vsig into the sub-pixel 11 and the mobility compensation process are carried out at the same time.

(b): Configuration of the First Control-Line Driving Section

The first control-line driving section 35 is a driving circuit for driving the write control signal lines WSL in order to sequentially control operations to write the signal electric potential Vsig or the like into sub-pixels 11 on a line-after-line basis.

Figure 11:
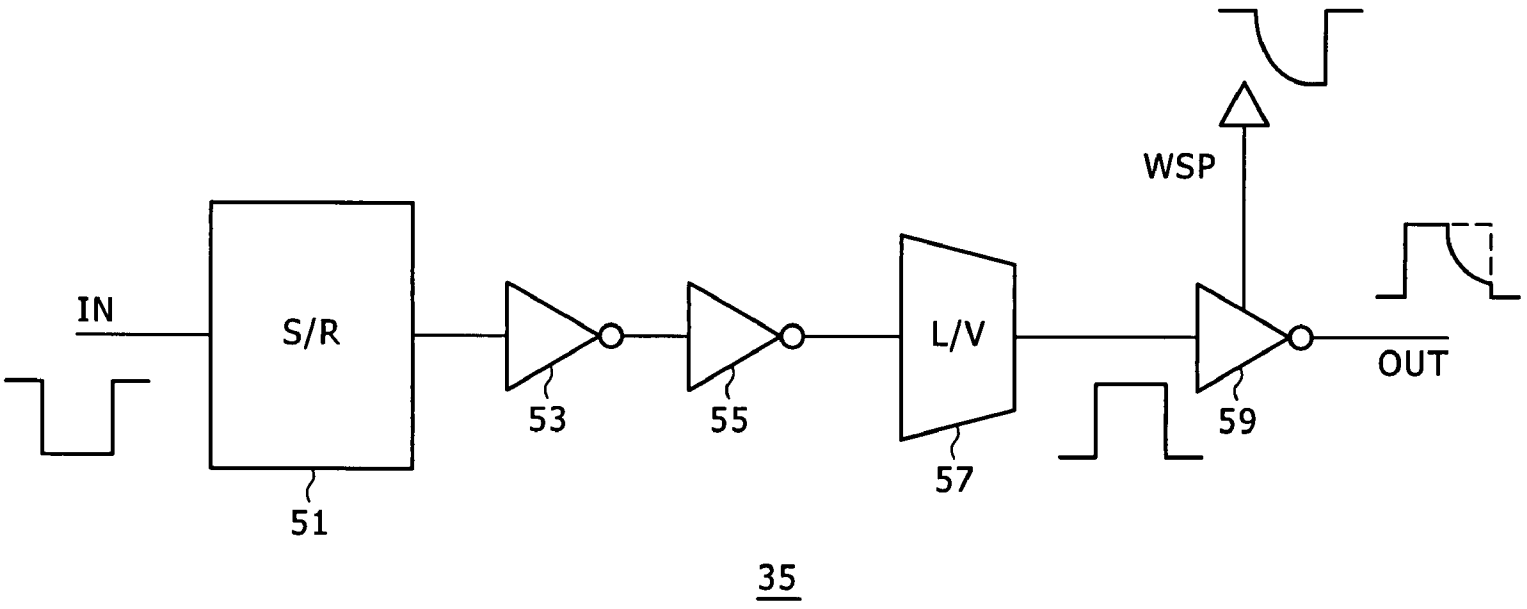
FIG. 11 is an explanatory diagram showing a typical partial configuration of a first control-line driving section for driving the write control signal line.

FIG. 11 is an explanatory diagram showing a typical partial configuration of the first control-line driving section 35. That is to say, the diagram of FIG. 11 shows the configuration for one horizontal line or one control signal line WSL. Thus, a plurality of configurations each shown in the diagram of FIG. 11 are laid out in the vertical direction of the screen. The number of configurations laid out in the vertical direction represents the vertical-direction resolution of the image displayed on the screen.

Figure 13:
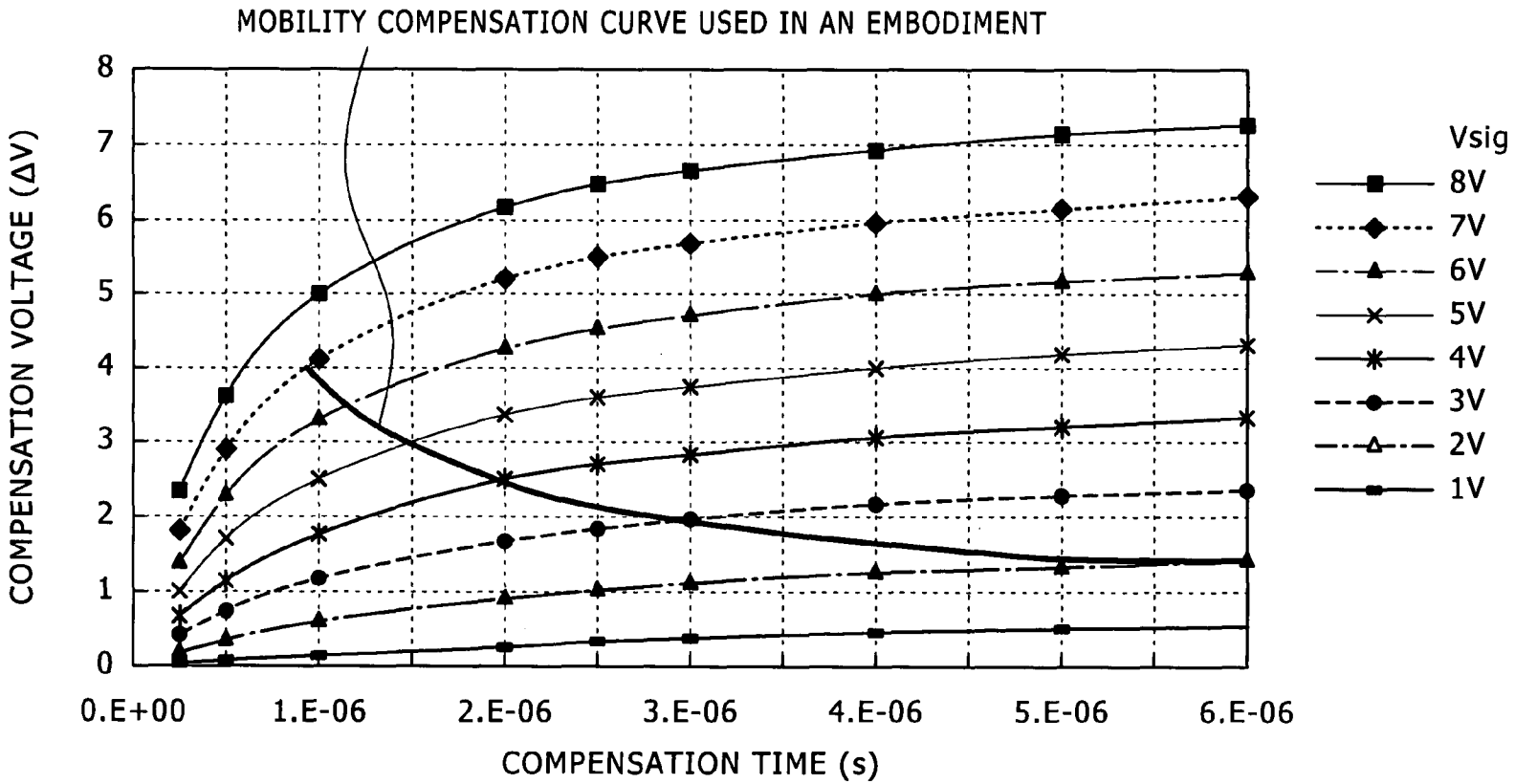
FIG. 13 is a diagram showing a bold line representing a mobility compensation curve adopted in the first embodiment.

In the following description, the partial circuit, the configuration of which is shown in the diagram of FIG. 11, is also referred to as the first control-line driving section 35 in order to make the explanation simpler. As shown in the figure, the first control-line driving section 35 employs a shift register 51, an inverter circuit 53 provided at a preceding stage, an inverter circuit 55 provided at a succeeding stage, a level shifter 57 and a single-stage inverter circuit 59. The preceding-stage inverter circuit 53 and the succeeding-stage inverter circuit 55 serve as a buffer circuit. A mobility-compensation curve shown in the diagram of FIG. 13 as a bold line is generated by the single-stage inverter circuit 59 in accordance with the level of the waveform of a power-supply voltage pulse WSP supplied to the single-stage inverter circuit 59. The mobility-compensation curve shown in the diagram of FIG. 13 is a curve representing a relation between the optimum mobility compensation time and the mobility-compensation voltage ΔV by which the source electric potential Vs of the device driving transistor N2 is raised during the mobility compensation process carried out in the optimum mobility compensation period. As described earlier, the mobility-compensation voltage ΔV is half the signal electric potential Vsig for the mobility compensation process.

Figure 12:
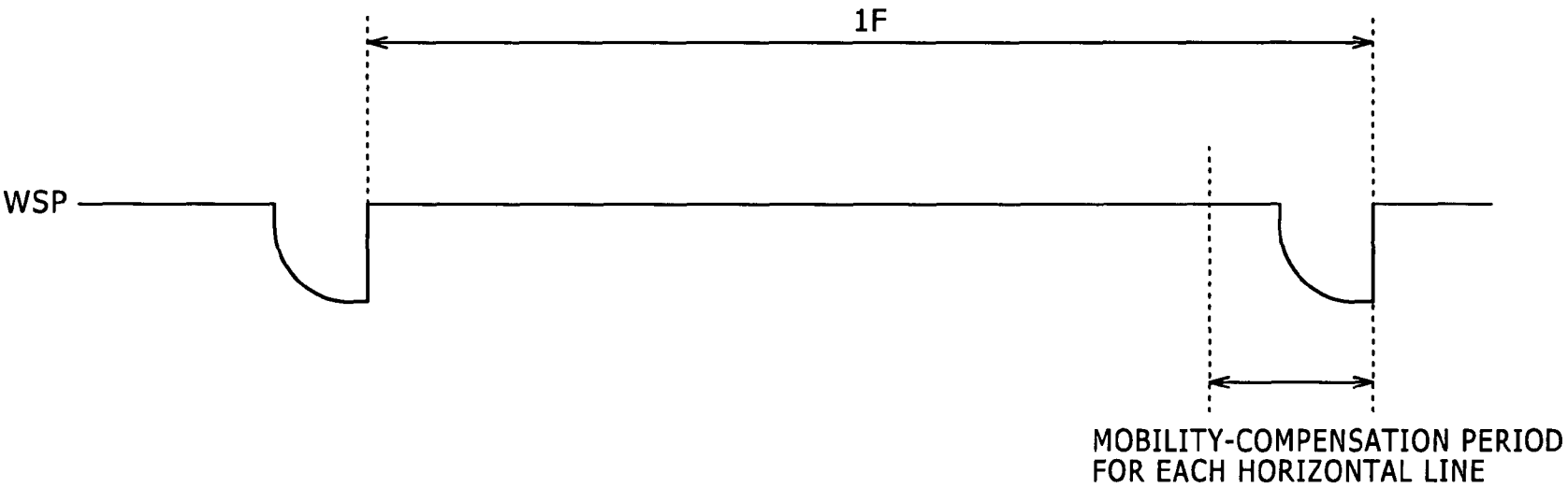
FIG. 12 is an explanatory diagram showing a waveform representing changes of a power-supply voltage pulse.

FIG. 12 is an explanatory diagram showing a waveform representing changes of the power-supply voltage pulse WSP.

As shown in the diagram of FIG. 12, the mobility-compensation curve portion for a horizontal line is set at a timing phase-synchronized to the mobility-compensation period for the horizontal line. In the case of the first embodiment, the mobility-compensation curve is set to have such a shape that a mobility-compensation process excessive for an applied signal electric potential Vsig is carried out. That is to say, the mobility-compensation curve is set to have such a shape that a mobility-compensation process excessive is carried out for every applied signal electric potential Vsig during a mobility-compensation period longer than the mobility-compensation time computed in accordance with Eq. (2).

FIG. 13 is a diagram showing a bold line representing the mobility compensation curve adopted in the first embodiment. In the case of the first embodiment, the maximum value of the signal electric potential Vsig is 7 V. Thus, the mobility compensation curve shown in the diagram of FIG. 13 starts from a graph corresponding to the signal electric potential Vsig of 7 V on the left side.

By the way, the mobility compensation curve shown in the diagram of FIG. 13 represents mobility compensation times each longer than the mobility-compensation time computed in accordance with Eq. (2) for the same signal electric potential Vsig as the signal electric potential Vsig corresponding to a point on the curve. The mobility compensation time represented by the mobility compensation curve shown in the diagram of FIG. 13 is deliberately set at a value larger than the value computed in accordance with Eq. (2) because it is necessary to consider a coupling effect incorporated as will be described later.

In the case of the first embodiment, even though the amplitude of the signal electric potential Vsig asserted on the data signal line DTL is reduced to 7 V, eventually, the same driving state as the case of an amplitude of 8 V is realized.

Thus, a mobility compensation curve is set so that, even for a case in which a signal electric potential Vsig of 7 V is asserted on the data signal line DTL as shown in the diagram of FIG. 13, a mobility-compensation voltage of 4 V can be assured as the same voltage as that for a case in which a signal electric potential Vsig of 8 V is asserted on the data signal line DTL as shown in the diagram of FIG. 8.

By the same token, for a case in which a signal electric potential Vsig of 6 V is asserted on the data signal line DTL as shown in the diagram of FIG. 13, it is possible to set a mobility compensation period for implementing a mobility-compensation voltage of 3.5 V as the same voltage as that for a case in which a signal electric potential Vsig of 7 V is asserted on the data signal line DTL as shown in the diagram of FIG. 8.

In the same way, for a case in which a signal electric potential Vsig of 5 V is asserted on the data signal line DTL as shown in the diagram of FIG. 13, it is possible to set a mobility compensation period for implementing a mobility-compensation voltage of 3 V as the same voltage as that for a case in which a signal electric potential Vsig of 6 V is asserted on the data signal line DTL as shown in the diagram of FIG. 8.

Similarly, for a case in which a signal electric potential Vsig of 4 V is asserted on the data signal line DTL as shown in the diagram of FIG. 13, it is possible to set a mobility compensation period for implementing a mobility-compensation voltage of 2.5 V as the same voltage as that for a case in which a signal electric potential Vsig of 5 V is asserted on the data signal line DTL as shown in the diagram of FIG. 8.

Likewise, for a case in which a signal electric potential Vsig of 3 V is asserted on the data signal line DTL as shown in the diagram of FIG. 13, it is possible to set a mobility compensation period for implementing a mobility-compensation voltage of 2 V as the same voltage as that for a case in which a signal electric potential Vsig of 4 V is asserted on the data signal line DTL as shown in the diagram of FIG. 8.

By the same token, for a case in which a signal electric potential Vsig of 2 V is asserted on the data signal line DTL as shown in the diagram of FIG. 13, it is possible to set a mobility compensation period for implementing a mobility-compensation voltage of 1.5 V as the same voltage as that for a case in which a signal electric potential Vsig of 3 V is asserted on the data signal line DTL as shown in the diagram of FIG. 8.

Figure 14:
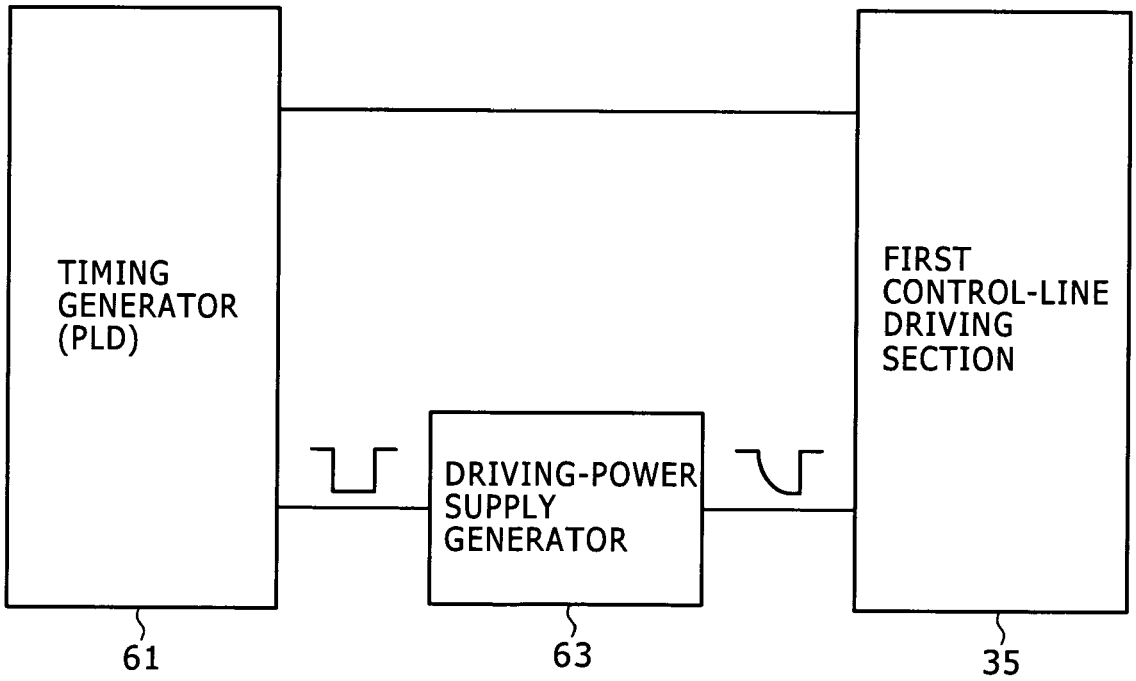
FIG. 14 is a block diagram showing the configuration of a circuit device for generating a power-supply voltage pulse.

FIG. 14 is a block diagram showing the configuration of a circuit for generating the power-supply voltage pulse WSP mentioned before and supplying the power-supply voltage pulse WSP to the first control-line driving section 35.

As shown in the block diagram of FIG. 14, the power-supply voltage pulse WSP is generated by a timing generator 61 and a driving power-supply generator 63. The timing generator 61 is a circuit for generating driving pulses each having a rectangular waveform supplied to not only the first control-line driving section 35, but also to the other control-line driving section and the driving power-supply generator 63. It is to be noted that the timing of the falling edge of the driving pulse lags behind the timing of the start timing of the mobility compensation period by a delay time determined in advance.

The driving power-supply generator 63 is a circuit for generating the power-supply voltage pulse WSP shown in the diagram of FIG. 12 on the basis of the driving pulse received from the timing generator 61 as a driving pulse having a rectangular waveform. As shown in the diagram of FIG. 12, the power-supply voltage pulse WSP has a waveform with a falling portion folded and bent at two stages.

Figure 15:
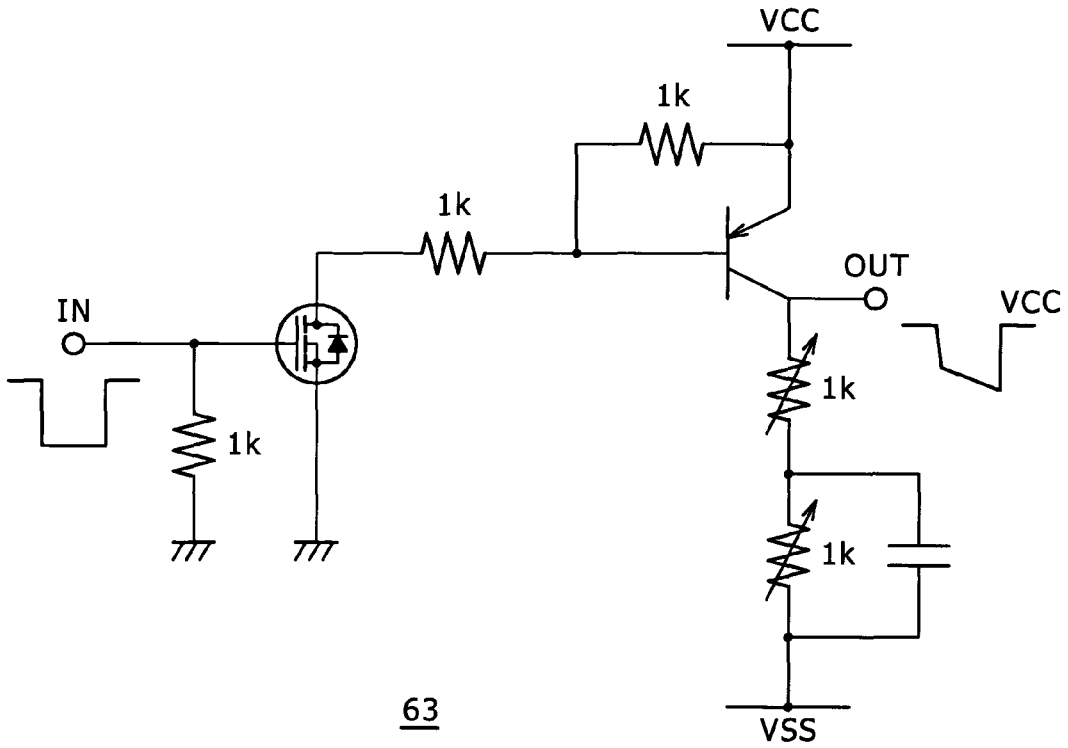
FIG. 15 is a diagram showing a typical circuit of a driving power-supply generator.

FIG. 15 is a diagram showing a typical circuit of the driving power-supply generator 63. The driving power-supply generator 63 shown in the circuit diagram of FIG. 15 is a typical pulse generator with a configuration for generating a pseudo power-supply voltage pulse WSP approximating the mobility compensation curve shown in the diagram of FIG. 13. As shown in the diagram of FIG. 15, the driving power-supply generator 63 employs two transistors, one capacitor, three resistors each having a fixed resistance and two resistors each having a variable resistance.

The driving power-supply generator 63 carries out an analog process on the input driving pulse in order to generate a power-supply voltage pulse WSP having a waveform with a falling portion folded and bent at two stages. The waveform falling portion folded and bent at the first stage has a large gradient whereas the waveform falling portion folded and bent at second first stage has a small gradient. Of course, by folding and bending the falling portion of the waveform of the power-supply voltage pulse WSP at several stages, it is possible to generate a power-supply voltage pulse WSP close to the ideal mobility compensation curve. The larger the number of stages, the closer the power-supply voltage pulse WSP to the ideal mobility compensation curve.

(c): Configuration of the Second Control-Line Driving Section

The second control-line driving section 37 is a driving circuit for controlling the switching from an operation to supply a driving power to sub-pixels 11 through lighting control signal lines LSL to an operation to supply no driving power to sub-pixels 11 and vice versa. It is to be noted that the second control-line driving section 37 of the first embodiment supplies a driving power to sub-pixels 11 at three stages. In other words, the second control-line driving section 37 asserts a first light emission electric potential Vcc1, a second light emission electric potential Vcc2 and a ground electric potential Vss, which have three different values, on the lighting control signal line LSL at three different times.

Figure 16:
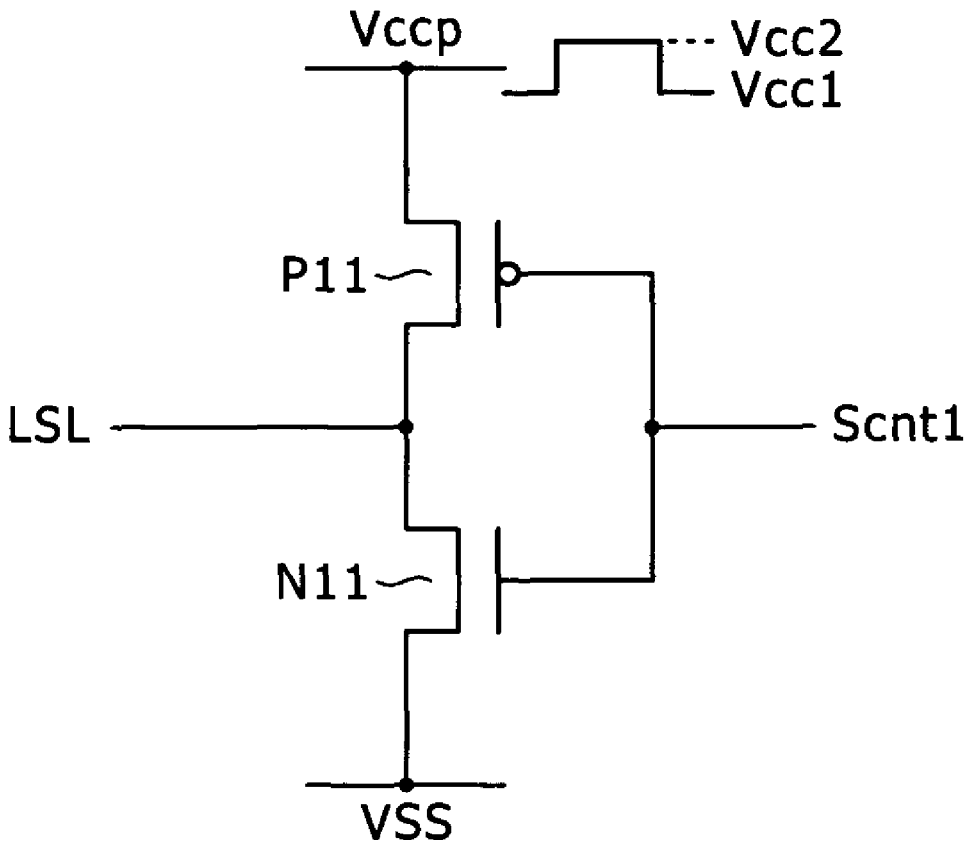
FIG. 16 is an explanatory diagram showing a typical partial configuration of a second control-line driving section for driving the lighting control signal line.

FIG. 16 is an explanatory diagram showing a typical partial configuration of the second control-line driving section 37. That is to say, the diagram of FIG. 16 shows the configuration of an output stage portion for one horizontal line or one lighting control signal line LSL. Thus, a plurality of configurations each shown in the diagram of FIG. 16 are laid out in the vertical direction of the screen. The number of configurations laid out in the vertical direction represents the vertical-direction resolution of the image displayed on the screen. In the following description, the partial circuit, the configuration of which is shown in the diagram of FIG. 16, is also referred to as the second control-line driving section 37 in order to make the explanation simpler.

In the case of the configuration shown in the diagram of FIG. 16 as the configuration of the second control-line driving section 37, a specific one of the two main electrodes of a P-channel thin-film transistor P11 designed as a transistor of the P-channel type is connected to a scan power-supply line Vccp whereas the other main electrode of the P-channel thin-film transistor P11 is connected to the lighting control signal line LSL. The lighting control signal line LSL is also connected to a specific one of the two main electrodes of a N-channel thin-film transistor N11 designed as a transistor of the N-channel type. It is to be noted that the other main electrode of the N-channel thin-film transistor N11 of the N-channel type is connected to a ground line conveying the ground electric potential VSS.

By the way, the control electrode of the thin-film transistor P11 designed as a transistor of the P-channel type and the control electrode of the thin-film transistor N11 designed as a transistor of the N-channel type are connected to a common control signal line Scnt1. Since the characteristic of the thin-film transistor P11 of the P-channel type is different from the characteristic of the thin-film transistor N11 of the N-channel type, when a specific one of them is put in a turned-off state, the other one of them is put in a turned-on state. That is to say, the thin-film transistor P11 of the P-channel type and the thin-film transistor N11 of the N-channel type operate complementarily to each other.

In the case of the first embodiment, the electric potential appearing on the control signal line Scnt1 is controlled by an output pulse generated by a corresponding output stage of a shift register, which is provided at the preceding stage, as a pulse having two binary values.

At the same time, the electric potential appearing on the scan power-supply line Vccp is controlled by an output pulse generated by a corresponding output stage of a shift register, which is provided at the preceding stage, as a pulse having two binary values.

In the case of the first embodiment, as shown in the diagram of FIG. 16, the two binary values of the scan power-supply line Vccp are the first light emission electric potential Vcc1 corresponding to a second driving voltage mentioned in a claim of this specification and the second light emission electric potential Vcc2 corresponding to a third driving voltage mentioned in a claim of this specification. In the case of the first embodiment, each of the first light emission electric potential Vcc1 and the second light emission electric potential Vcc2 is sufficient for driving the device driving transistor N2 to operate in a saturated region for all levels of the signal electric potential Vsig. As a matter of fact, the relatively low first light emission electric potential Vcc1 can be an electric potential that causes the device driving transistor N2, to which the signal electric potential Vsig corresponding to the pixel gradation has been applied, to operate in a linear region. In addition, the difference between the first light emission electric potential Vcc1 and the second light emission electric potential Vcc2 is set at such a value that a voltage portion propagating to the gate electrode of the device driving transistor N2 due to a coupling effect becomes the gate electric potential Vg which is assumed to have a magnitude of 1 V in the case of the first embodiment.

Figures 17A, 17B, 17C:
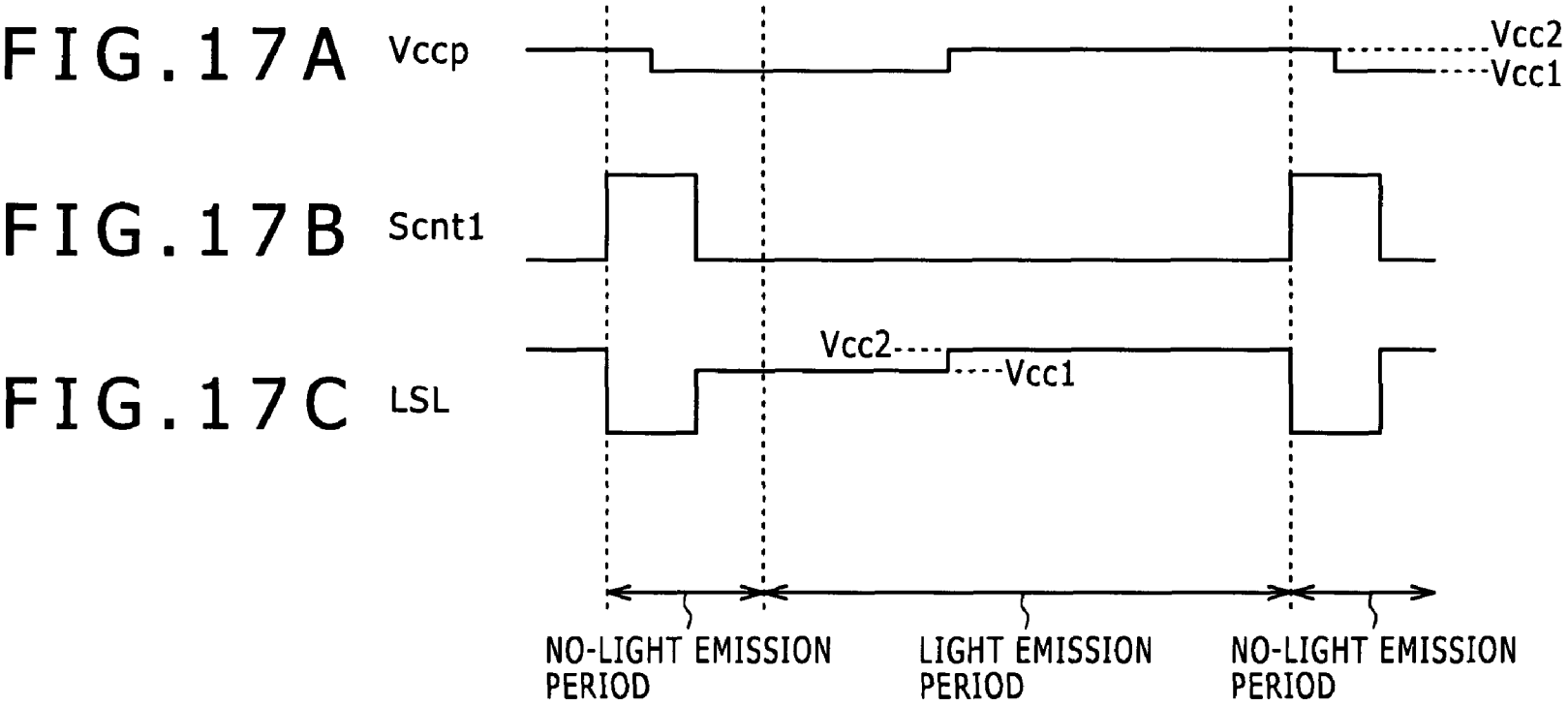
FIGS. 17A to 17C are timing charts showing waveforms representing changes of a driving signal appearing on the lighting control signal line.

FIGS. 17A to 17C are timing charts showing relations between the waveforms of signals of the second control-line driving section 37 and operation periods of the pixel circuit. To be more specific, FIG. 17A is a timing chart showing a waveform representing changes of a driving signal appearing on the scan power-supply line Vccp whereas FIG. 17B is a timing chart showing a waveform representing changes of a driving signal appearing on the control signal line Scnt1. FIG. 17C is a timing chart showing a waveform representing changes of an electric potential appearing on the lighting control signal line LSL.

As shown in the timing diagrams of FIGS. 17A to 17C, while the driving signal appearing on the control signal line Scnt1 is being sustained at the H level, the thin-film transistor N11 of the N-channel type is driven to enter a turned-on state, controlling the electric potential appearing on the lighting control signal line LSL to the L level. While the driving signal appearing on the control signal line Scnt1 is being sustained at the L level, on the other hand, the thin-film transistor P11 of the P-channel type is driven to enter a turned-on state, outputting the driving signal appearing on the scan power-supply line Vccp to the lighting control signal line LSL.

(B-2): Driving Operations

The following description explains typical driving operations carried out by the organic EL panel module 31 according to the first embodiment.

Figures 18A, 18B, 18C, 18D, 18E:
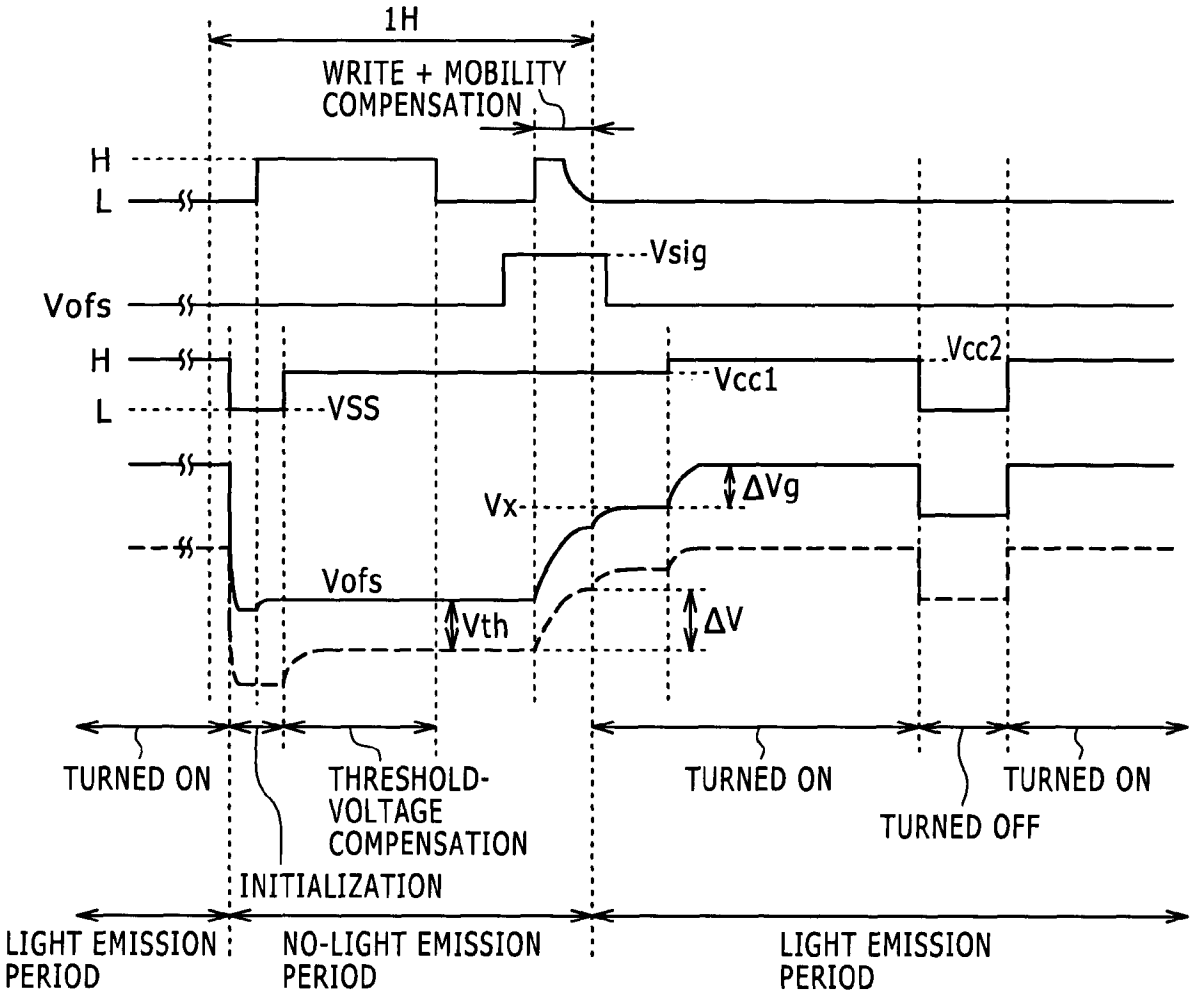
FIGS. 18A to 18E are timing charts showing waveforms representing changes of a driving signal according to the first embodiment.

FIGS. 18A to 18E are explanatory timing charts showing changes of electric potentials inside a sub-pixel 11. To be more specific, FIG. 18A is a timing chart showing a waveform representing changes of a driving signal appearing on the write control signal line WSL whereas FIG. 18B is a timing chart showing a waveform representing changes of a driving signal appearing on the data signal line DTL. FIG. 18C is a timing chart showing a waveform representing changes of a driving signal appearing on the lighting control signal line LSL whereas FIG. 18D is a timing chart showing a waveform representing changes of a gate electric potential Vg appearing at the gate electrode of the device driving transistor N2. FIG. 18E is a timing chart showing a waveform representing changes of a source electric potential Vs appearing at the source electrode of the device driving transistor N2.

(a): Initialization Process

When the electric potential appearing on the lighting control signal line LSL is controlled to change to the L level of the ground electric potential Vss, a light emission period is ended and a no-light emission period is started. When the no-light emission period is started, an initialization process of the sub-pixel 11 is carried out in order to make a preparation for a new process to store a signal electric potential Vsig into the signal holding capacitor Cs. Strictly speaking, the initialization process of the sub-pixel 81 is carried out in order to lower the gate electric potential Vg of the device driving transistor N2 and the source electric potential Vs of the device driving transistor N2 as shown in the timing charts of FIGS. 18D and 18E respectively.

Figure 19:
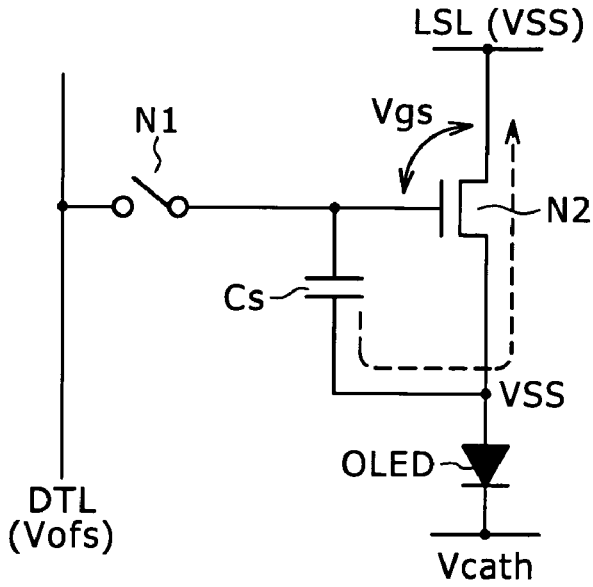
FIG. 19 is an explanatory diagram showing an equivalent circuit of the sub-pixel to serve as a circuit representing the state of the sub-pixel at the start of an initialization process.

FIG. 19 is an explanatory diagram showing an equivalent circuit of the sub-pixel 11 to serve as a circuit representing the state of the sub-pixel 11 at the start of the no-light emission period or the start of the initialization process. As shown in the circuit diagram of FIG. 19, the signal sampling transistor N1 has been put in a turned-off state.

When the driving signal appearing on the lighting control signal line LSL is set at the L level of the ground electric potential Vss as described above, a voltage Vgs appearing between the gate electrode of the device driving transistor N2 and the lighting control signal line LSL as shown in the circuit diagram of FIG. 19 becomes greater than the threshold voltage Vth of the device driving transistor N2. Thus, the device driving transistor N2 is put in a turned-on state, drawing electric charge accumulated in the signal holding capacitor Cs as shown by a dashed-line arrow shown in the circuit diagram of FIG. 19. The electric charge accumulated in the signal holding capacitor Cs is drawn, causing the source electric potential Vs of the device driving transistor N2 to decrease to a level equal to the ground electric potential VSS. In addition, the gate electric potential Vg of the device driving transistor N2 is also lowered because of a coupling effect due to the decrease of the source electric potential Vs.

(b): Threshold-Voltage Compensation Preparation Process and Threshold-Voltage Compensation Process When the initialization process described above is ended, the signal sampling transistor N1 is put in a turned-on state by raising the driving signal appearing on the write control signal line WSL to the H level in order to apply the offset electric potential Vofs used as a reference electric potential to the gate electrode of the device driving transistor N2.

Figure 20:
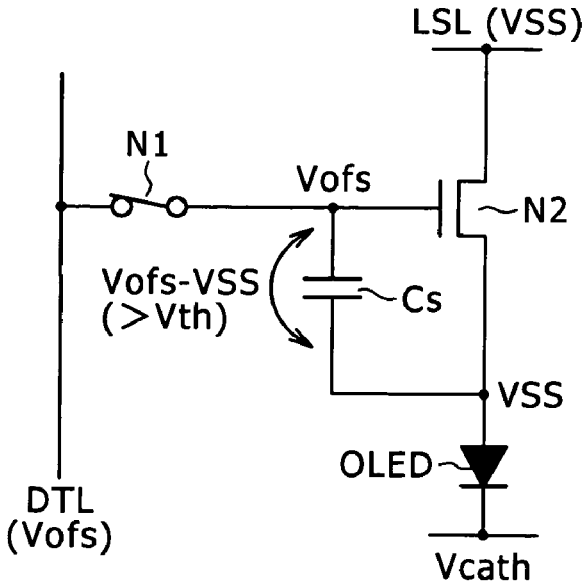
FIG. 20 is an explanatory diagram showing an equivalent circuit of the sub-pixel at the end of a threshold-voltage compensation preparation process.

FIG. 20 is an explanatory diagram showing an equivalent circuit of the sub-pixel 11 to serve as a circuit representing this state. During the threshold-voltage compensation preparation process, the signal holding capacitor Cs is controlled to enter a state in which a voltage having a magnitude of (Vofs−VSS). The ground electric potential Vss and the offset electric potential Vofs are set at such values that the voltage having a magnitude of (Vofs−VSS) is greater than the threshold voltage Vth of the device driving transistor N2. As the voltage appearing between the electrodes of the signal holding capacitor Cs exceeds the threshold voltage Vth of the device driving transistor N2, the threshold-voltage compensation preparation process can be said to have been ended.

In actuality, when the voltage appearing between the electrodes of the signal holding capacitor Cs is assumed to have exceeded the threshold voltage Vth of the device driving transistor N2, the electric potential appearing on the lighting control signal line LSL is changed from the ground electric potential Vss to the first light emission electric potential Vcc1, which is the intermediate electric potential among the three electric potentials to be asserted on the lighting control signal line LSL, in order to start a threshold-voltage compensation process.

Figure 21:
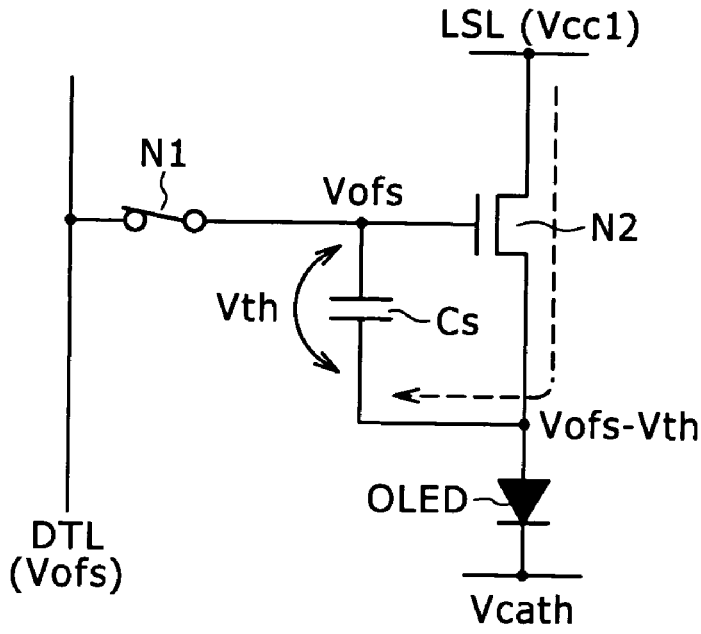
FIG. 21 is an explanatory diagram showing an equivalent circuit of the sub-pixel to serve as a circuit representing the state of the sub-pixel during a threshold-voltage preparation process.
Figure 22:
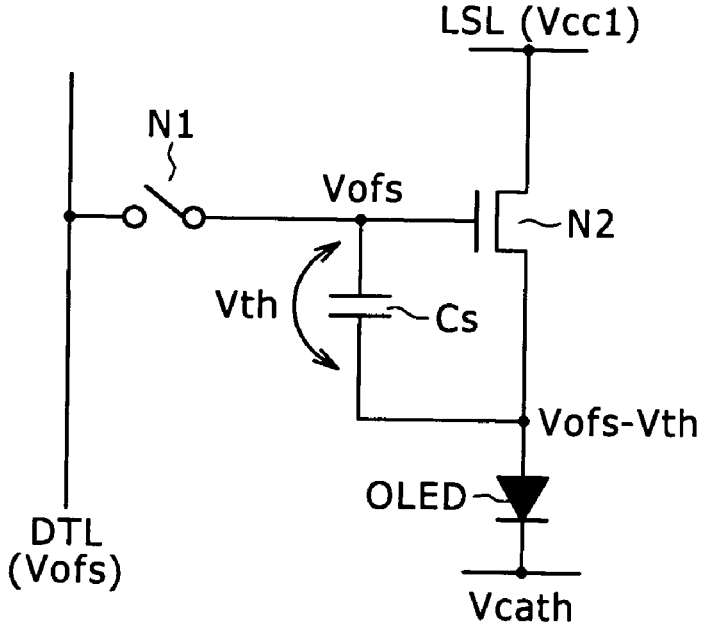
FIG. 22 is an explanatory diagram showing an equivalent circuit of the sub-pixel to serve as a circuit representing the state of the sub-pixel at the end of the threshold-voltage compensation process.

FIG. 21 is an explanatory diagram showing an equivalent circuit of the sub-pixel 11. At the start of the threshold-voltage preparation process, the voltage appearing between the electrodes of the signal holding capacitor Cs exceeds the threshold voltage Vth of the device driving transistor N2, that is, the gate-source voltage Vgs of the device driving transistor N2 is greater than the threshold voltage Vth of the device driving transistor N2. Thus, the device driving transistor N2 is put in a turned-on state, causing a driving current Ids to flow in a direction from the lighting control signal line LSL to the signal holding capacitor Cs. The driving current Ids flowing in a direction from the lighting control signal line LSL to the signal holding capacitor Cs neutralizes electric charge accumulated in the signal holding capacitor Cs, causing the source electric potential Vs of the device driving transistor N2 to start rising.

As the electric charge accumulated in the signal holding capacitor Cs is neutralized, the voltage appearing between the electrodes of the signal holding capacitor Cs becomes equal to the threshold voltage Vth of the device driving transistor N2. At the point of time the voltage appearing between the electrodes of the signal holding capacitor Cs becomes equal to the threshold voltage Vth of the device driving transistor N2, the driving current Ids stops to flow. This is because the device driving transistor N2 automatically enters a cut-off state. The process to set the gate-source voltage Vgs of the device driving transistor N2 at the threshold voltage Vth of the device driving transistor N2 is referred to as the threshold-voltage compensation process.

When the threshold-voltage compensation process is assumed to have ended, the signal sampling transistor N1 is controlled to enter a turned-off state by changing the driving signal appearing on the write control signal line WSL from the H level to the L level.

Of course, after the device driving transistor N2 enters a cut-off state at the end of the threshold-voltage compensation process, the electric potentials appearing at a variety of points in the sub-pixel 11 remain unchanged.

(c): Signal Electric-Potential Write Process and Mobility Compensation Process

At a point of time after the threshold-voltage compensation process has been ended, the electric potential appearing on the data signal line DTL is changed from the offset electric potential Vofs to the signal electric potential Vsig. Then, the write control signal line WSL is controlled to rise from the L level to the H level in order to put the signal sampling transistor N1 in a turned-on state.

Figure 23:
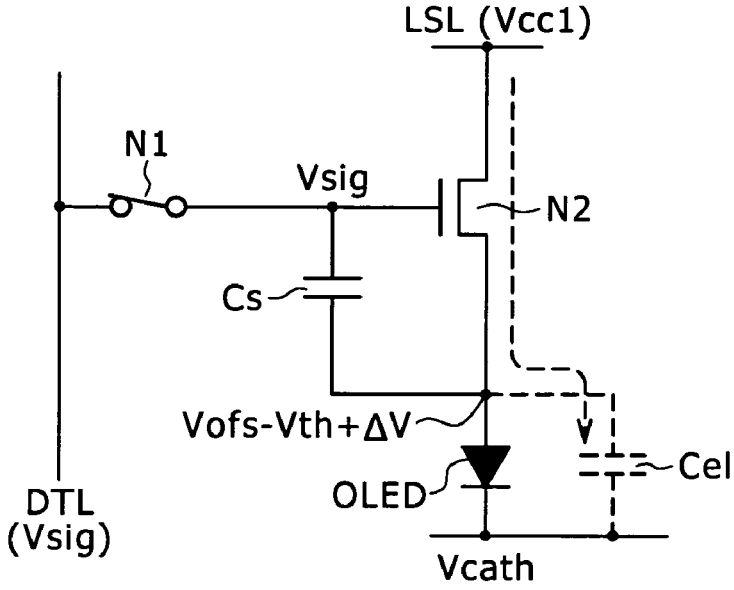
FIG. 23 is an explanatory diagram showing an equivalent circuit of the sub-pixel to serve as a circuit representing the state of the sub-pixel at the start of a signal electric-potential write process and a mobility compensation process.

FIG. 23 is an explanatory diagram showing an equivalent circuit of the sub-pixel 11 to serve as a circuit representing the state of the sub-pixel 11 at the start of the signal electric-potential write process and the mobility compensation process. Since the signal sampling transistor N1 is in a turned-on state, the signal electric potential Vsig appearing on the data signal line DTL is stored in the signal holding capacitor Cs so that the voltage of the signal holding capacitor Cs again exceeds the threshold voltage Vth. As a result, the device driving transistor N2 is controlled to enter a turned-on state. The process to store the signal electric potential Vsig appearing on the data signal line DTL in the signal holding capacitor Cs is referred to as the signal electric-potential write process.

Thus, the operation carried out by the device driving transistor N2 to supply the driving current Ids to the organic EL device OLED is started. The driving current Ids flows to electrically charge the parasitic capacitor Cel of the organic EL device OLED and the like. Since the driving current Ids electrically charges the parasitic capacitor Cel, the electric potential appearing at the anode of the organic EL device OLED rises by an electric-potential increase equal to the mobility compensation voltage ΔV. It is to be noted that the electric potential appearing at the anode of the organic EL device OLED is the source electric potential Vs of the device driving transistor N2. In general, the mobility compensation process is carried out in order to produce the mobility compensation voltage ΔV equal to half the signal electric potential Vsig. In the case of the first embodiment, however, the mobility compensation time T is controlled, being deliberately set at a value longer than the mobility compensation time t found from the signal electric potential Vsig. In the timing chart of FIG. 18A, the mobility compensation time T is the width of the later pulse. Thus, the mobility compensation voltage ΔV generated during the mobility compensation time T in accordance with the first embodiment is greater than half the signal electric potential Vsig actually asserted on the data signal line DTL.

In addition, the mobility compensation voltage ΔV is deliberately set at such a value that the electric potential does not exceed the threshold voltage Vth(oeld) of the organic EL device OLED.

Thus, the organic EL device OLED is not operating during the mobility compensation process. That is to say, the organic EL device OLED stays in a no-light emission state during the mobility compensation process.

(d): Light Emission Process (Including a Coupling Operation)

Figure 24:
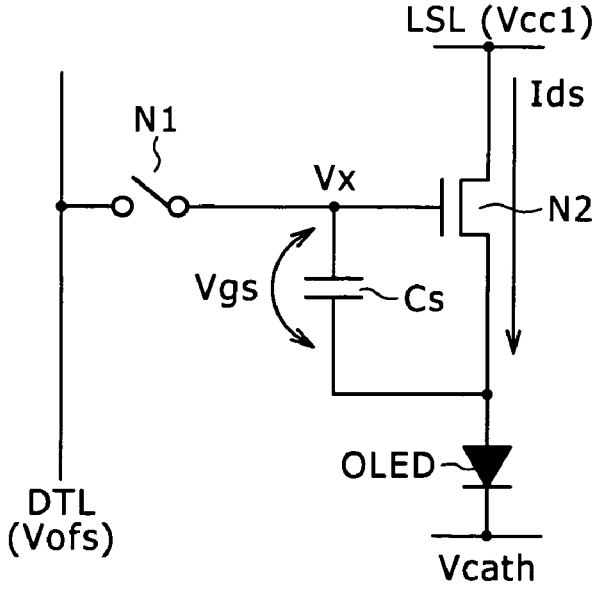
FIG. 24 is an explanatory diagram showing an equivalent circuit of the sub-pixel to serve as a circuit representing the state of the sub-pixel at the start of a light emission process.

When it is assumed that the mobility compensation process have been completed, the signal sampling transistor N1 is put in a turned-off state. FIG. 24 is an explanatory diagram showing an equivalent circuit of the sub-pixel 11 at the end of the mobility compensation process.

At the end of the mobility compensation process, the gate electrode of the device driving transistor N2 is put in a floating state. Thus, the gate electric potential Vg of the device driving transistor N2 also rises along with the source electric potential Vs due to a bootstrap operation. As soon as the source electric potential Vs exceeds the threshold voltage Vth (oled) of the organic EL device OLED, however, the organic EL device OLED is put in a turned-on state, starting a light emission process to emit light at a luminance level in accordance with the driving current Ids which is determined by the gate-source voltage Vgs. As described earlier, the gate-source voltage Vgs is a voltage stored in the signal holding capacitor Cs.

In the first embodiment, the gate electric potential Vg appearing at the gate electrode of the device driving transistor N2 at the start of the light emission process is referred to as an electric potential Vx.

One of operations peculiar to the first embodiment is carried out thereafter to increase the electric potential appearing on the lighting control signal line LSL from the first light emission electric potential Vcc1 to the second light emission electric potential Vcc2. The second light emission electric potential Vcc2 is the highest electric potential among the three electricpotentials applied to the lighting control signal line LSL.

Figure 25:
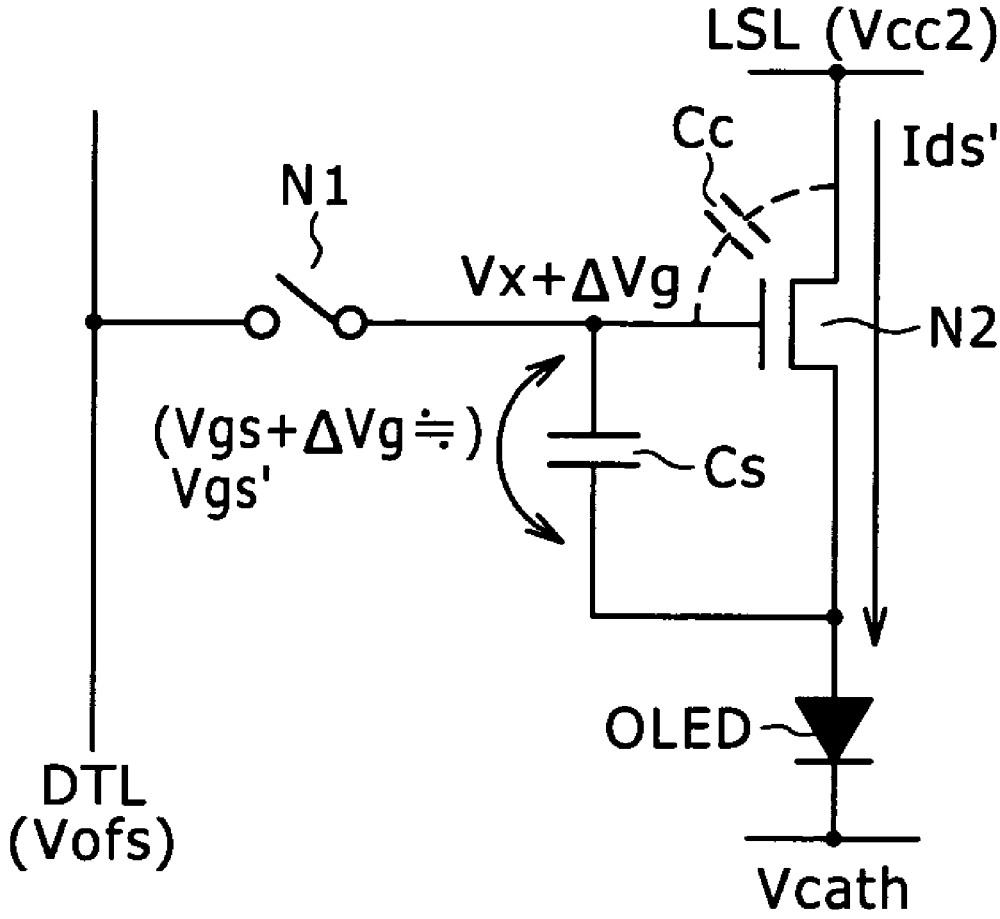
FIG. 25 is an explanatory diagram showing an equivalent circuit of the sub-pixel to serve as a circuit representing the state of the sub-pixel at the coupling operation.

FIG. 25 is an explanatory diagram showing an equivalent circuit of the sub-pixel 11 representing the state. At the point of time the electric potential appearing on the lighting control signal line LSL is raised from the first light emission electric potential Vcc1 to the second light emission electric potential Vcc2, a portion of the electric-potential change (=Vcc2−Vcc1) is passed on to the gate electrode by way of a parasitic capacitor Cc existing between the gate and drain electrodes of the device driving transistor N2.

Let notation ΔVg denote the electric-potential change portion. Thus, the gate electric potential Vg is increased from the electric potential Vx to an electric potential of (Vx+ΔVg). The electric-potential change portion ΔVg can be found from the electric-potential increase (Vcc2−Vcc1) in accordance with the following equation:

$$\Delta Vg=\{Cc/(Cc+Cs)\}\cdot(Vcc2-Vcc1).$$

By the way, while the gate electric potential Vg is increasing, the source electric potential Vs barely rises. This is because the source electric potential Vs is basically determined by the threshold voltage Vth (oled) of the organic EL device OLED.

Thus, the voltage held by the signal holding capacitor Cs also increases from Vgs to Vgs' (=Vgs+ΔVg).

When the voltage held by the signal holding capacitor Cs increases from Vgs to Vgs' in this way, the driving current also rises from Ids to Ids'. Thus, the organic EL device OLED is put in a state of emitting light at a luminance level higher than the luminance level according to the signal electric potential Vsig.

Even if the organic EL device OLED is put in a state of emitting light at a higher luminance level, however, variations in mobility compensation make it impossible to prevent the image quality from becoming poor due to uniformity deteriorations.

In the case of the first embodiment, however, the mobility compensation voltage ΔV generated during an excessive mobility compensation process is deliberately increased through proper adjustment by assuming a desired gate-source voltage Vgs' after the coupling process. Thus, an electric-potential relation obtained after the coupling process is an electric-potential relation proper for the gate-source voltage Vgs' after the coupling process.

By referring to timing charts shown in FIGS. 26A to 26D, the following description explains the fact that the electric-potential relation obtained after the coupling process is proper. FIG. 26A is a timing chart showing a waveform representing changes of the driving signal appearing on the write control signal line WSL whereas FIG. 26B is a timing chart showing a waveform representing changes of the driving signal appearing on the lighting control signal line LSL. FIG. 26C is a timing chart showing a waveform representing changes of the gate electric potential Vg of the device driving transistor N2 whereas FIG. 26D is a timing chart showing a waveform representing changes of the source electric potential Vs of the device driving transistor N2.

Figure 26:
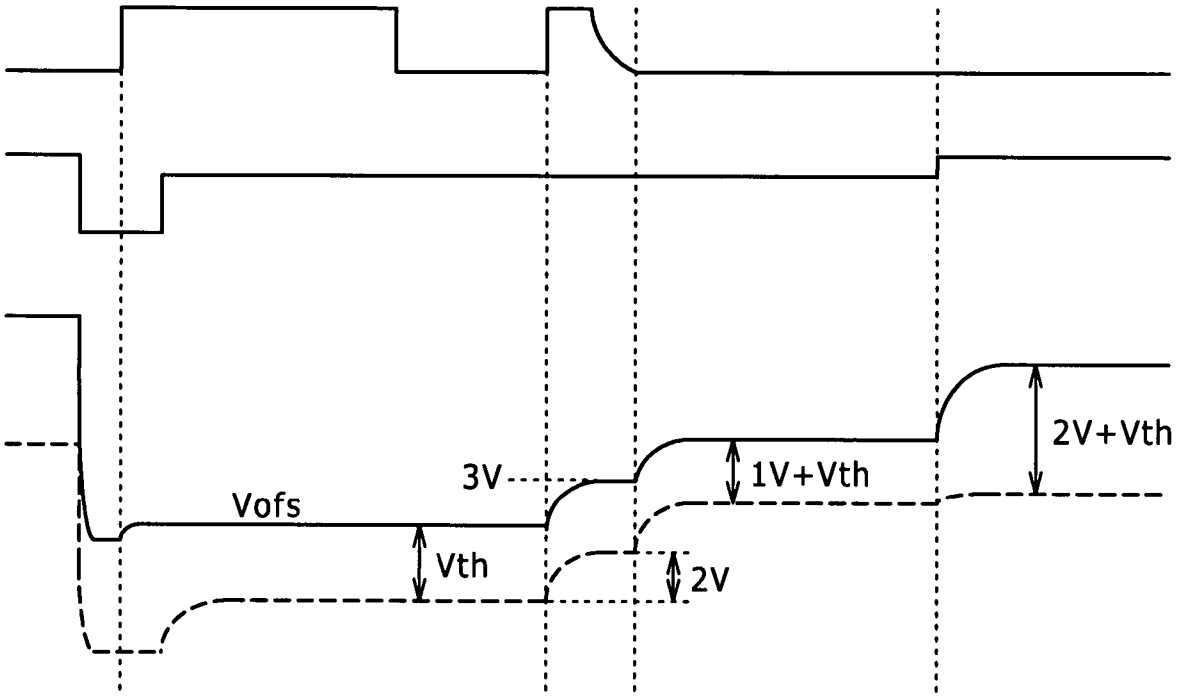
FIGS. 26A to 26D are timing charts showing changes of the gate-to-source electric potential of the device driving transistor during the driving operation of the embodiment.

In the timing diagram of FIG. 26, the signal electric potential Vsig actually asserted on the data signal line DTL is assumed to be 3 V. The mobility compensation time T shown in the timing chart of FIG. 26A is controlled, being set at a value longer than the mobility compensation time t. For a signal electric potential Vsig of 3 V, the mobility-compensation voltage found by calculation is 1.5 V. In this case, however, a mobility-compensation voltage of 2 V is produced. That is to say, for a signal electric potential Vsig, the mobility-compensation process is carried out excessively. As a result of the execution of the mobility compensation process, the gate-source voltage Vgs of the device driving transistor N2 is set at (1 V+Vth).

If the electric potential appearing on the lighting control signal line LSL is raised from the first light emission electric potential Vcc1 to the second light emission electric potential Vcc2, the gate electric potential Vg of the device driving transistor N2 is also increased due to a coupling effect provided by the parasitic capacitor Cc by ΔVg which is set at 1 V.

As a result, the gate-source voltage Vgs of the device driving transistor N2 is increased to (2 V+Vth). The state is the same as a state which would be obtained as if a signal electric potential Vsig of 4 V had been asserted on the data signal line DTL in a mobility compensation process carried out.

(B-3): Effects of the First Embodiment

As described above, the lighting control signal line LSL is driven by a driving signal set at three different electric potentials. That is to say, the first embodiment adopts a driving method by which the first light emission electric potential Vcc1 is applied to the lighting control signal line LSL during the threshold-voltage compensation process and the mobility compensation process and, after the light emission period has been started, the second light emission electric potential Vcc2 is applied to the lighting control signal line LSL. In other words, the first embodiment adopts a driving method by which a portion of an electric-potential change generated on the lighting control signal line LSL from the first light emission electric potential Vcc1 to the second light emission electric potential Vcc2 is superposed on the gate electrode of the thin film transistor due to a coupling effect.

In addition, the first embodiment adopts a driving method by which, by considering the electric-potential change portion superposed on the gate electrode due to a coupling effect, the mobility compensation time T is deliberately lengthened to a value longer than the mobility compensation time obtained by calculation for the signal electric potential Vsig actually asserted on the data signal line DTL.

By adoption of the driving methods described above, it is possible to display an image at a luminance level higher than the ordinary driving methods while properly assuring a mobility compensation voltage appropriate for the gate-source voltage Vgs demanded for displaying the image.

Thus, it is possible to implement an organic EL panel module 31 in which the uniformity of the displayed image is enhanced and the quality of the displayed image is improved to provide a higher level of luminance in comparison with the image uniformity and the image quality which are provided by the ordinary driving methods.

(C): Second Embodiment (C-2): System Configuration

Figure 27:
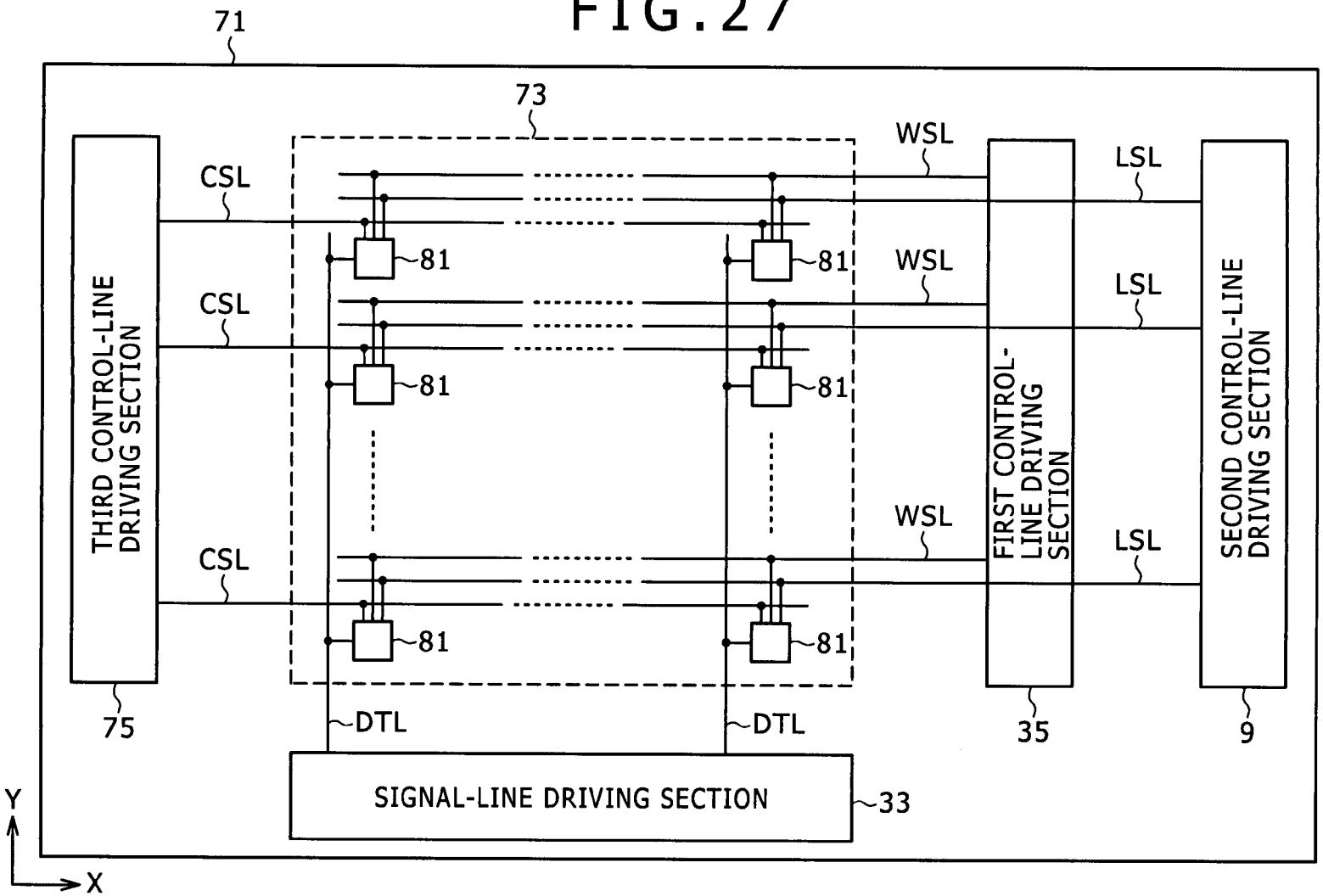
FIG. 27 is a block diagram showing a typical system configuration of an organic EL panel module according to a second embodiment.

FIG. 27 is a block diagram showing a typical system configuration of an organic EL panel module 71 according to a second embodiment. In the block diagram of FIG. 27, components identical with their respective counterparts shown in the block diagrams of FIGS. 1 and 8 are denoted by the same reference numerals or the same reference notations as the counterparts. The second embodiment is identical with the first embodiment in that the execution of the same driving operations as the first embodiment is also the need of the second embodiment.

The organic EL panel module 71 shown in the block diagram of FIG. 27 employs a pixel array section 73, a signal-line driving section 33, a first control-line driving section 35, a second control-line driving section 9 and a third control-line driving section 75. Each of the signal-line driving section 33, the first control-line driving section 35, the second control-line driving section 9 and the third control-line driving section 75 is a circuit for driving the pixel array section 73.

Two configuration sections unique to the second embodiment are the pixel array section 73 and the newly added third control-line driving section 75. The other configuration sections of the second embodiment are identical with those of the configuration shown in the block diagram of FIG. 1 or FIG. 8.

The following description explains the configurations of the circuits peculiar to the second embodiment.

(a): Configuration of the Pixel Array Section

In the case of the second embodiment, the pixel array section 73 has sub-pixels 81 laid out to form a two-dimensional matrix.

Figure 3:
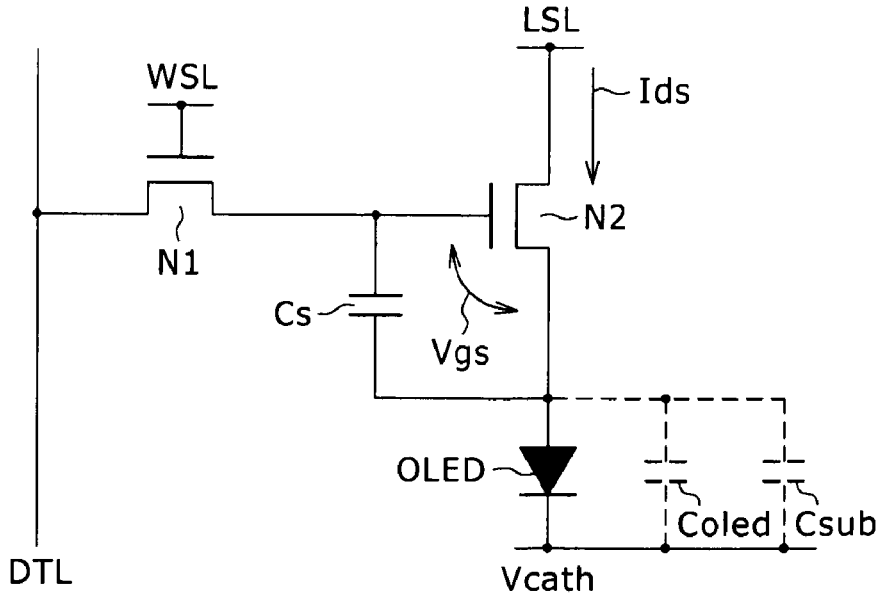
FIG. 3 RELATED ART
FIG. 3 is an explanatory circuit diagram showing the structure of a sub-pixel.
Figures 4A, 4B, 4C, 4D, 4E:
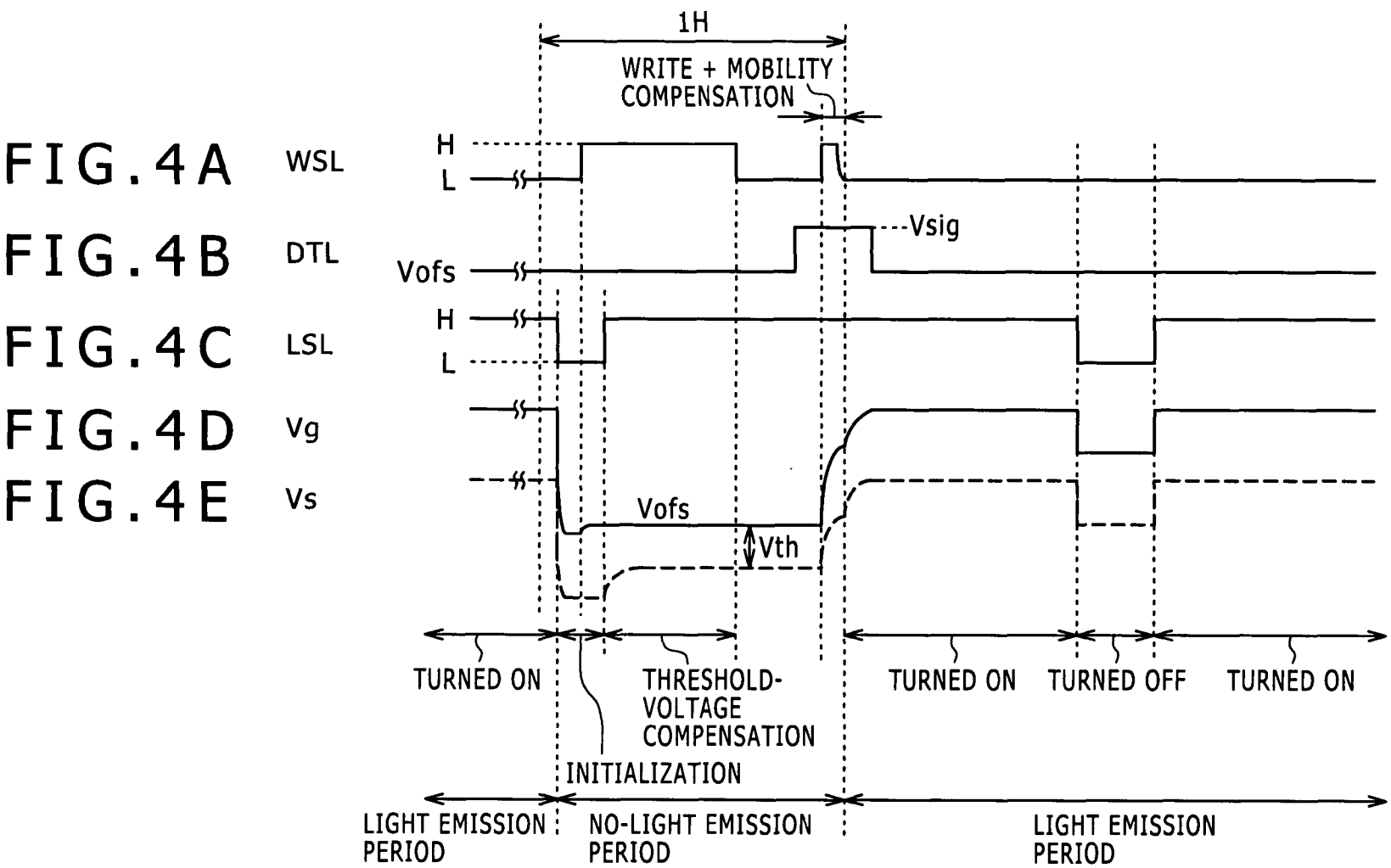
FIGS. 4A to 4E are explanatory timing diagrams showing timing charts of operations to drive the sub-pixel.
Figure 5:
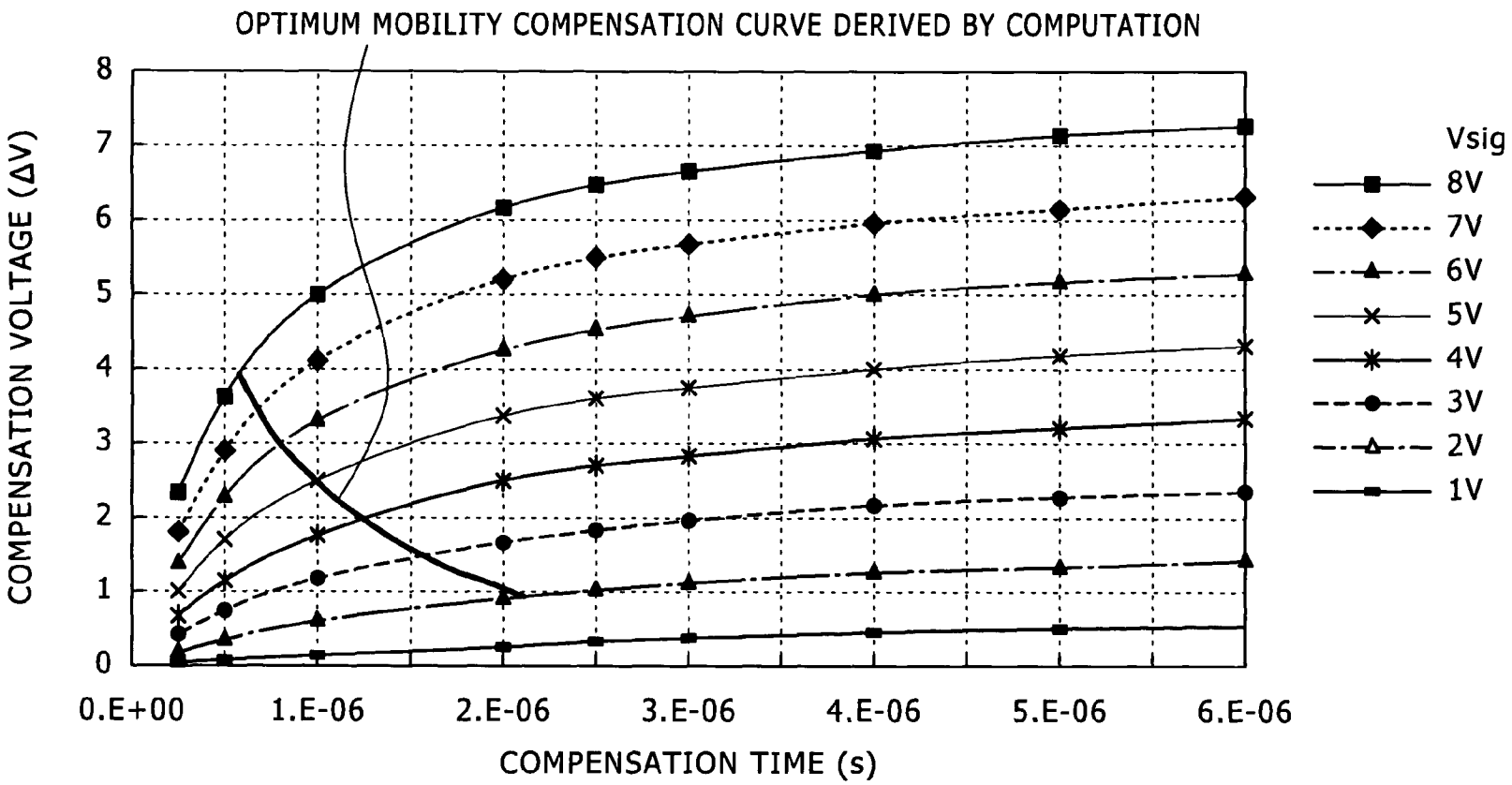
FIG. 5 is an explanatory diagram showing an optimum mobility compensation curve derived by a computation.
Figure 6:
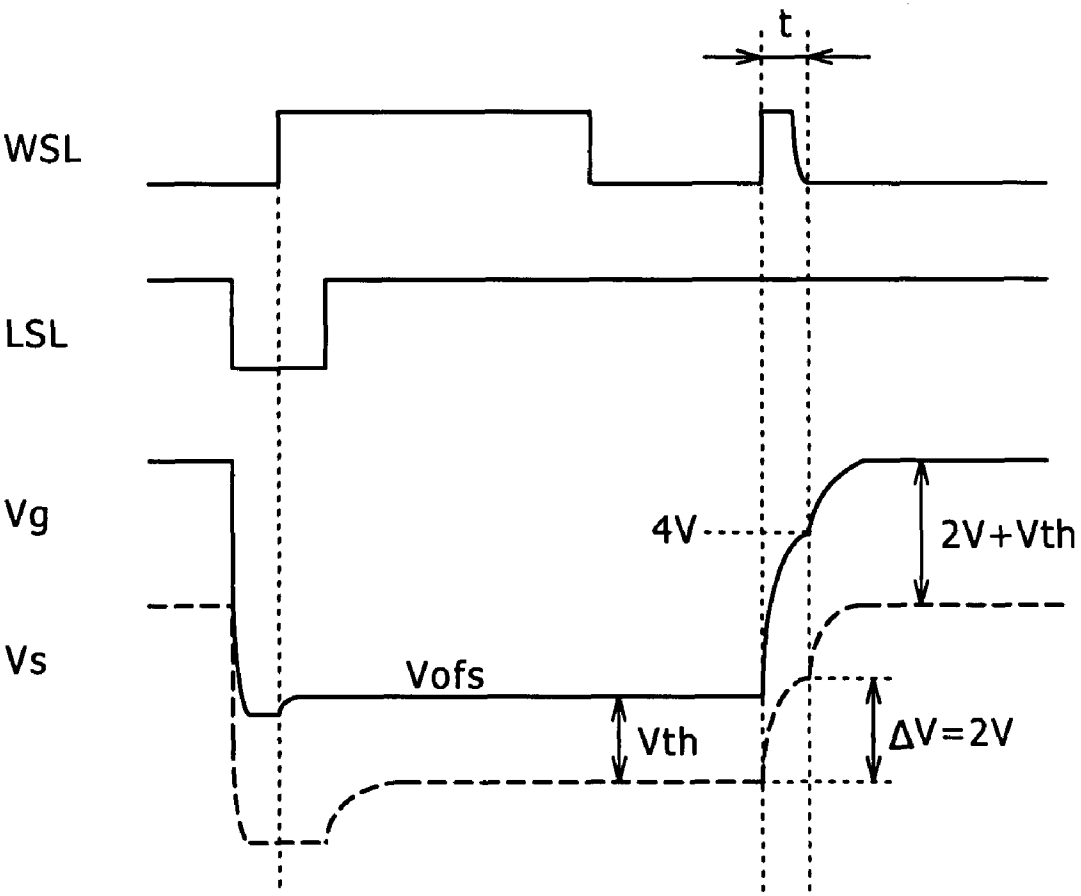
FIGS. 6A to 6D are timing charts showing changes of the gate-to-source electric potential of the device driving transistor N2.
Figure 28:
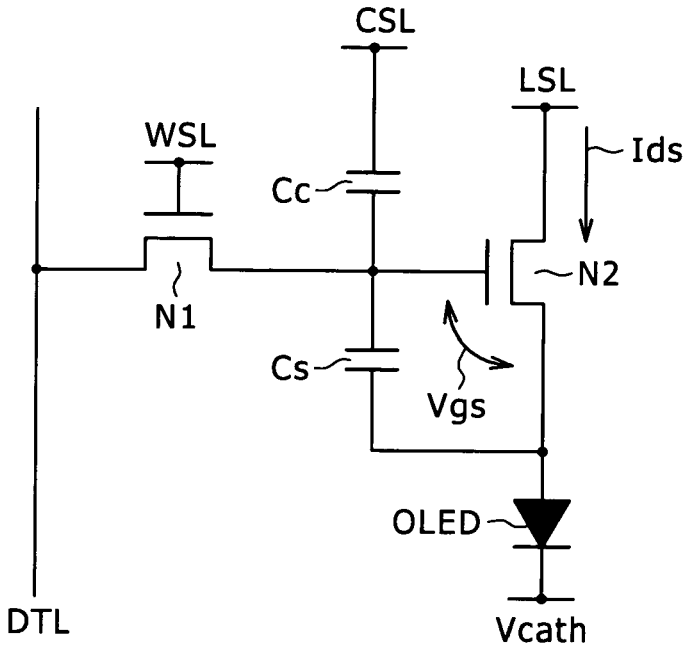
FIG. 28 is an explanation circuit diagram showing the configuration of a sub-pixel employed in the second embodiment.

FIG. 28 is an explanatory circuit diagram showing the configuration of the sub-pixel 81. It is to be noted that, in the circuit diagram of FIG. 28, components identical with their respective counterparts employed in the configuration shown in the circuit diagram of FIG. 3 are denoted by the same reference numerals or the same reference notations as the counterparts.

As shown in the circuit diagram of FIG. 28, the sub-pixel 81 employs a signal sampling transistor N1, a device driving transistor N2, a signal holding capacitor Cs to hold a signal potential Vsig, a dedicated coupling capacitor Cc and an organic EL device OLED.

The sub-pixel 81 employed in the second embodiment is different from the sub-pixel 11 employed in the first embodiment in that the sub-pixel 81 has the dedicated coupling capacitor Cc. The dedicated coupling capacitor Cc is a dedicated capacitor provided for superposing a coupling voltage on the gate electrode of the device driving transistor N2 during a light emission process. In the case of the sub-pixel 11 employed in the first embodiment, a parasitic capacitor Cc existing between the gate electrode employed in the device driving transistor N2 and the main electrode is used as a coupling capacitor. In the case of the second embodiment, on the other hand, the dedicated coupling capacitor Cc is used. The capacitance of the dedicated coupling capacitor Cc employed in the sub-pixel 81 can be made greater than the capacitance of the parasitic capacitor Cc employed in the first embodiment. However, a coupling control signal line CSL for controlling a coupling operation is newly demanded. A coupling control signal line CSL is needed for every horizontal line.

(b): Third Control-Line Driving Section

The third control-line driving section 75 is a circuit for controlling an operation to supply a coupling voltage to the sub-pixel 81 through the coupling control signal line CSL. In the case of the second embodiment, the third control-line driving section 75 supplies the coupling voltage to the sub-pixel 81 at two different electric potentials. For example, the third control-line driving section 75 sets the coupling voltage asserted on the coupling control signal line CSL at the H level such as Vcc2 or the L level such as Vcc1.

Figure 29:
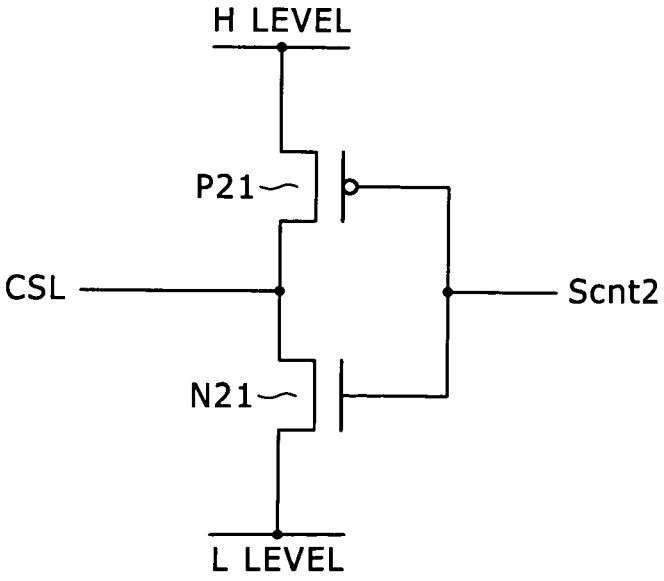
FIG. 29 is an explanatory diagram showing a partial configuration of a third control-line driving section for driving a coupling control signal line.

FIG. 29 is an explanatory diagram showing a partial configuration of the third control-line driving section 75. That is to say, the diagram of FIG. 29 shows the configuration of an output stage portion for one horizontal line. Thus, a plurality of configurations each shown in the diagram of FIG. 29 are laid out in the vertical direction of the screen. The number of configurations laid out in the vertical direction represents the vertical-direction resolution of the image displayed on the screen. In the following description, the partial circuit, the configuration of which is shown in the diagram of FIG. 29, is also referred to as the third control-line driving section 75.

In the case of the configuration shown in the diagram of FIG. 29 as the configuration of the third control-line driving section 75, a specific one of the two main electrodes of a thin-film transistor P21 designed as a transistor of the P-channel type is connected to an H-level power-supply line whereas the other main electrode is connected to the coupling control signal line CSL. The coupling control signal line CSL is also connected to a specific one of the two main electrodes of a thin-film transistor N21 designed as a transistor of the N-channel type. It is to be noted that the other main electrode of the thin-film transistor N21 of the N-channel type is connected to an L-level power-supply line.

By the way, the gate electrode of the thin-film transistor P21 of the P-channel type and the gate electrode of the N-channel thin-film transistor N21 are connected to a common control line Scnt2. Since the characteristic of the thin-film transistor P21 of the P-channel type is different from the characteristic of the thin-film transistor N21 of the N-channel type, when a specific one of them is put in a turned-off state, the other one of them is put in a turned-on state. That is to say, the thin-film transistor P21 of the P-channel type and the thin-film transistor N21 of the N-channel type operate complementarily to each other.

In the case of the second embodiment, the electric potential appearing on the common control line Scnt2 is controlled by an output pulse generated by a corresponding output stage of a shift register, which is provided at the preceding stage, as a pulse having two binary values.

(C-2): Driving Operations

The following description explains typical driving operations carried out by the organic EL panel module 71 according to the second embodiment.

Figures 30A, 30B, 30C, 30D, 30E, 30F:
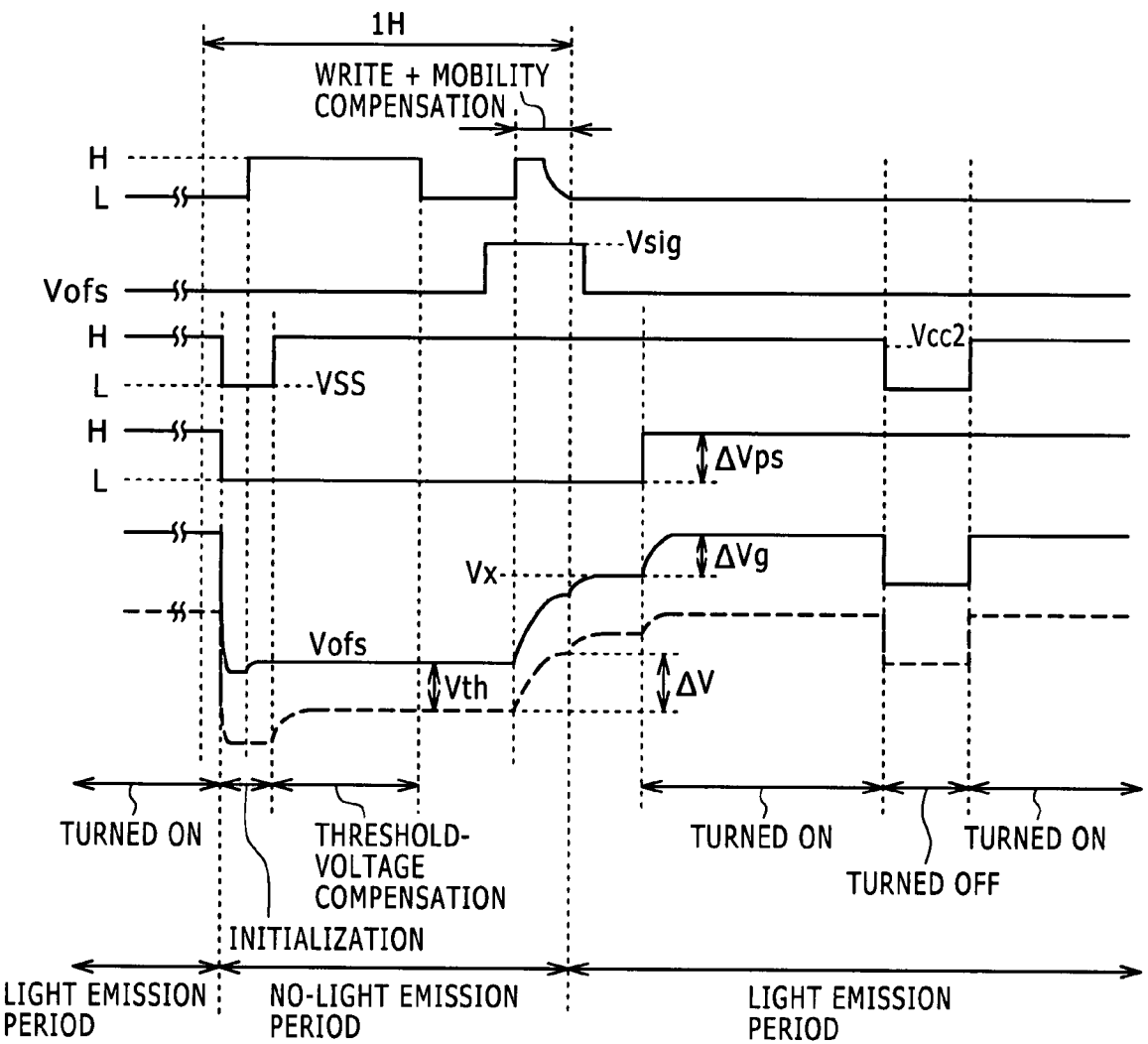
FIGS. 30A to 30F are timing charts showing waveforms representing changes of driving signals according to the second embodiment.

FIGS. 30A to 30F are explanatory timing charts showing changes of electric potentials inside a sub-pixel 81. To be more specific, FIG. 30A is a timing chart showing a waveform representing changes of a driving signal appearing on the write control signal line WSL whereas FIG. 30B is a timing chart showing a waveform representing changes of a driving signal appearing on the data signal line DTL. FIG. 30C is a timing chart showing a waveform representing changes of a driving signal appearing on the lighting control signal line LSL whereas FIG. 30D is a timing chart showing a waveform representing changes of a driving signal appearing on the coupling control signal line CSL. FIG. 30E is a timing chart showing a waveform representing changes of a gate electric potential Vg of the device driving transistor N2 whereas FIG. 30F is a timing chart showing a waveform representing changes of a source electric potential Vs of the device driving transistor N2.

(a): Initialization Process

When a light emission period is ended, a no-light emission period is started. When the no-light emission period is started, the initialization process of the sub-pixel 81 is carried out in order to make a preparation for a new process to store a signal electric potential Vsig.

In addition, when the electric potential appearing on the lighting control signal line LSL is set at the ground electric potential VSS, the electric potential appearing on the coupling control signal line CSL is also controlled to change from the H level to the L level. When the electric potential appearing on the coupling control signal line CSL is controlled to change from the H level to the L level, a coupling effect is exhibited. Since the sub-pixel 81 is carrying out an initialization process, however, the coupling effect does not have an effect on a light emission process as well as the aforementioned threshold-voltage compensation process.

(b): Threshold-Voltage Compensation Preparation Process and Threshold-Voltage Compensation Process The initialization process described above is ended and the signal sampling transistor N1 is put in a turned-on state in order to apply the offset electric potential Vofs used as a reference electric potential to the gate electrode of the device driving transistor N2. At the end of the threshold-voltage compensation preparation process, the gate-source voltage Vgs of the device driving transistor N2 is equal to a difference of (Vofs−VSS) which is greater than the threshold voltage Vth of the device driving transistor N2. The process is referred to as a threshold-voltage compensation preparation process.

In actuality, when the voltage appearing between the electrodes of the signal holding capacitor Cs is assumed to have exceeded the threshold voltage Vth of the device driving transistor N2, the electric potential appearing on the lighting control signal line LSL is changed to the second light emission electric potential Vcc2 as described above in order to start a threshold-voltage compensation process in which the drain-source voltage Vds appearing between the drain and source electrodes of the device driving transistor N2 is increased. Thus, the device driving transistor N2 is put in a turned-on state, causing a driving current Ids to flow in a direction from the lighting control signal line LSL to the signal holding capacitor Cs. As a result, electric charge accumulated in the signal holding capacitor Cs is neutralized. While the driving current Ids is flowing in a direction from the lighting control signal line LSL to the signal holding capacitor Cs, the source electric potential Vs of the device driving transistor N2 starts to rise.

It is to be noted that the source electric potential Vs rises so that the voltage appearing between the electrodes of the signal holding capacitor Cs becomes equal to the threshold voltage Vth of the device driving transistor N2. At the point of time, the driving current Ids stops to flow. This because the device driving transistor N2 automatically enters a cut-off state.

When the threshold-voltage compensation process is assumed to have ended, the signal sampling transistor N1 is controlled to enter a turned-off state. Of course, after the device driving transistor N2 enters a cut-off state, the electric potentials remain unchanged.

(c): Signal Electric-Potential Write Process and Mobility Compensation Process

At a time after the threshold-voltage compensation process has been ended, the electric potential appearing on the data signal line DTL is changed from the offset electric potential Vofs to the signal electric potential Vsig. Then, the write control signal line WSL is controlled to rise from the L level to the H level in order to put the signal sampling transistor N1 in a turned-on state.

The signal electric potential Vsig is stored in the signal holding capacitor Cs so that the gate-source voltage Vgs of the device driving transistor N2 again exceeds the threshold voltage Vth. As a result, the device driving transistor N2 is controlled to enter a turned-on state.

The driving current Ids flows to electrically charge the parasitic capacitor Cel and the like. Since the driving current Ids electrically charges the parasitic capacitor Cel, the electric potential appearing at the anode of the organic EL device OLED rises equal to the mobility compensation voltage ΔV. In the case of the second embodiment, however, the mobility compensation time T is set at a value longer than the mobility compensation time t found from the signal electric potential Vsig. In the timing chart of FIG. 30A, the mobility compensation time T is the width of the later pulse. Thus, the mobility compensation voltage ΔV generated during the mobility compensation time T is greater than half the signal electric potential Vsig.

In addition, the mobility compensation voltage ΔV is deliberately set at such a value that does not exceed the threshold voltage Vth (oled) of the organic EL device OLED.

Thus, the organic EL device OLED is not operating during the mobility compensation process. That is to say, the organic EL device OLED stays in a no-light emission state during the mobility compensation process.

(d): Light Emission Process (Including a Coupling Operation)

When it is assumed that the mobility compensation process has been completed, the signal sampling transistor N1 is put in a turned-off state. At the end of the mobility compensation process, the gate electrode of the device driving transistor N2 is put in a floating state. Accordingly, the source electric potential Vs of the device driving transistor N2 keeps rising. Thus, the gate electric potential Vg of the device driving transistor N2 also rises along with the source electric potential Vs of the device driving transistor N2 due to a coupling effect provided by a bootstrap operation. As soon as the source electric potential Vs of the device driving transistor N2 exceeds the threshold voltage Vth (oled) of the organic EL device OLED, however, the organic EL device OLED is put in a turned-on state, starting a light emission process to emit light at a luminance level in accordance with a voltage stored in the signal holding capacitor Cs.

Also in the case of the second embodiment, the gate electric potential Vg appearing at the gate electrode of the device driving transistor N2 at the start of the light emission process is referred to as an electric potential Vx.

Then, the electric potential appearing on the coupling control signal line CSL is increased from the L level to the H level by a difference ΔVps.

At the point of time the electric potential appearing on the coupling control signal line CSL is changed from the L level to the H level, a portion of the electric-potential change ΔVps is passed on to the gate electrode of the device driving transistor N2 by way of the dedicated coupling capacitor Cc.

Let notation ΔVg denote the electric-potential change portion passed on to the gate electrode of the device driving transistor N2 by way of the dedicated coupling capacitor Cc. Thus, the gate electric potential Vg of the device driving transistor N2 is increased from the electric potential Vx to an electric potential of (Vx+ΔVg). The electric-potential change portion ΔVg can be found from the electric-potential change ΔVps in accordance with the following equation:

$$\Delta Vg=\{Cc/(Cc+Cs)\}\cdot\Delta Vps.$$

By the way, while the gate electric potential Vg of the device driving transistor N2 is increasing, the source electric potential Vs of the device driving transistor N2 barely rises. This is because the source electric potential Vs of the device driving transistor N2 is basically determined by the threshold voltage Vth (oled) of the organic EL device OLED.

Thus, the voltage held by the signal holding capacitor Cs also increases from Vgs to Vgs' (=Vgs+Δvg).

When the voltage held by the signal holding capacitor Cs increases from Vgs to Vgs' in this way, the driving current also rises from Ids to Ids'. Thus, the organic EL device OLED is put in a state of emitting light at a luminance level higher than the luminance level according to the signal electric potential Vsig actually supplied.

It is to be noted that the driving operation described above is the same as that carried out by the first embodiment. Thus, after the coupling operation based on the coupling effect, electric potentials are related properly to the gate-source voltage Vgs' obtained after the coupling operation based on the coupling effect.

(C-3): Effects of the Second Embodiment

As described above, in the case of the second embodiment, the coupling control signal line CSL is driven by a driving signal set at two different electric potentials, i.e., electric potentials of the L and H levels. That is to say, the second embodiment adopts a driving method by which a driving signal of the L level is applied to the coupling control signal line CSL during the threshold-voltage compensation process and the mobility compensation process and, after the light emission period has been started, a driving signal of the H level is applied to the coupling control signal line CSL. In other words, the second embodiment adopts a driving method by which a portion of an electric-potential change ΔVps made on the coupling control signal line CSL as a change from the L level to the H level is superposed on the gate electrode of the thin film transistor due to a coupling effect provided by the dedicated coupling capacitor Cc.

In addition, the second embodiment adopts a driving method by which, by considering the superposed electric-potential change portion due to a coupling effect, the mobility compensation time is deliberately lengthened to a value longer than the mobility compensation time obtained by calculation for the signal electric potential Vsig actually asserted.

By adoption of the driving methods described above, it is possible to display an image at a luminance level higher than the ordinary driving methods while properly assuring a mobility compensation voltage appropriate for the gate-source voltage Vgs required for displaying the image.

Thus, it is possible to implement an organic EL panel module 71 in which the uniformity of the displayed image is enhanced and the quality of the displayed image is improved to provide a higher level of luminance in comparison with the image uniformity and the image quality which are provided by the ordinary driving methods.

(D): Other Embodiments (D-1): Another Typical Configuration of the Second Control-Line Driving Section In the case of the first embodiment described above, the second control-line driving section 37 having a configuration shown in the circuit diagram of FIG. 16 functions as a section for driving the lighting control signal line LSL.

Figure 31:
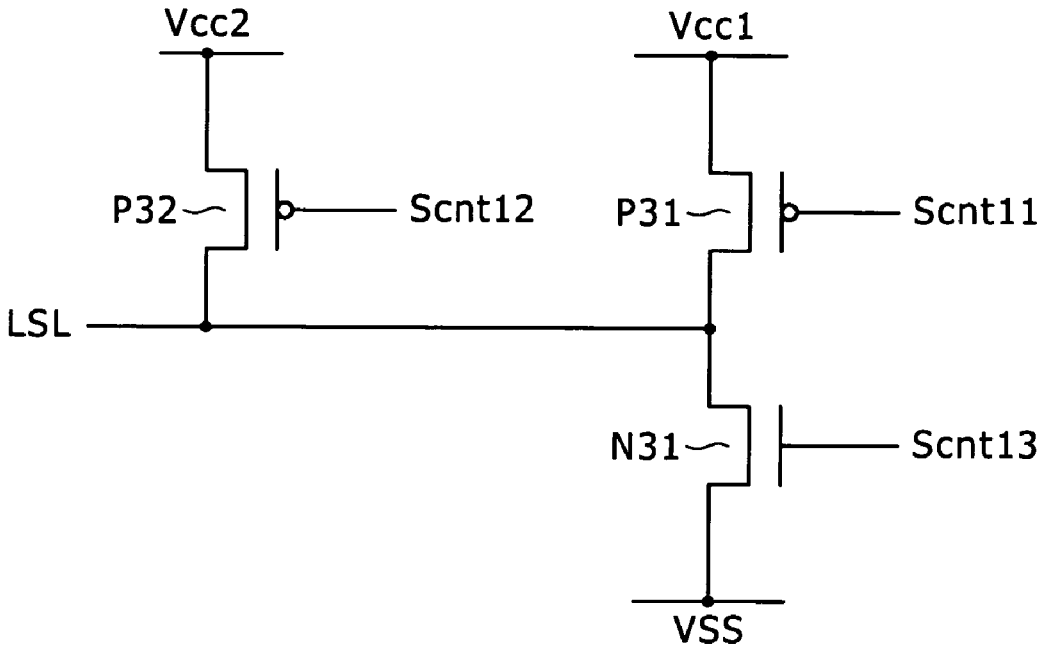
FIG. 31 is an explanatory circuit diagram showing another configuration of the second control-line driving section which is also proper for driving the lighting control signal line.

However, the second control-line driving section can have another circuit configuration. FIG. 31 is an explanatory circuit diagram showing another configuration of the second control-line driving section 37 which is also proper for driving the lighting control signal line LSL.

In the case of the second control-line driving section 37 shown in the circuit diagram of FIG. 31, a switch is provided for each of the three electric potentials Vss, Vcc1 and Vcc2 to be applied to the lighting control signal line LSL. Each of the switches is typically a thin-film transistor.

In the case of the second control-line driving section 37 shown in the circuit diagram of FIG. 31, thin-film transistors P31 and P32 of the P-channel type are connected in parallel to the lighting control signal line LSL.

A specific one of the two main electrodes of the first P-channel thin-film transistor P31 is connected to a power supply line on which the first light emission electric potential Vcc1 is asserted and the other main electrode of the first P-channel thin-film transistor P31 is connected to the lighting control signal line LSL. On the other hand, a specific one of the two main electrodes of the second P-channel thin-film transistor P32 is connected to a power supply line on which the second light emission electric potential Vcc2 is asserted and the other main electrode of the second P-channel thin-film transistor P32 is connected to the lighting control signal line LSL.

A specific one of the two main electrodes of a thin-film transistor N31 designed as a transistor of the N-channel type is connected in series to the two thin-film transistors P31 and P32 whereas the other main electrode of the N-channel thin-film transistor N31 is connected to the ground electric potential VSS.

In the case of the second control-line driving section 37 shown in the circuit diagram of FIG. 31, the gate electrodes of the first P-channel thin-film transistor P31, the second P-channel thin-film transistor P32 and the N-channel thin-film transistor N31 are connected to dedicated control signal lines Scnt11, Scnt12 and Scnt13 respectively.

To be more specific, the gate electrode of the first P-channel thin-film transistor P31 is connected to the dedicated control signal line Scnt11, the gate electrode of the second P-channel thin-film transistor P32 is connected to the dedicated control signal line Scnt12 and the gate electrode of the N-channel thin-film transistor N31 is connected to the dedicated control signal line Scnt13.

The electric potential appearing on each of the dedicated control signal line Scnt11, the dedicated control line Scnt12 and the dedicated control signal line Scnt13 is controlled by an output pulse generated by a corresponding output stage of a shift register, which is provided at the preceding stage, as a pulse having two binary values.

Figures 32A, 32B, 32C, 32D:
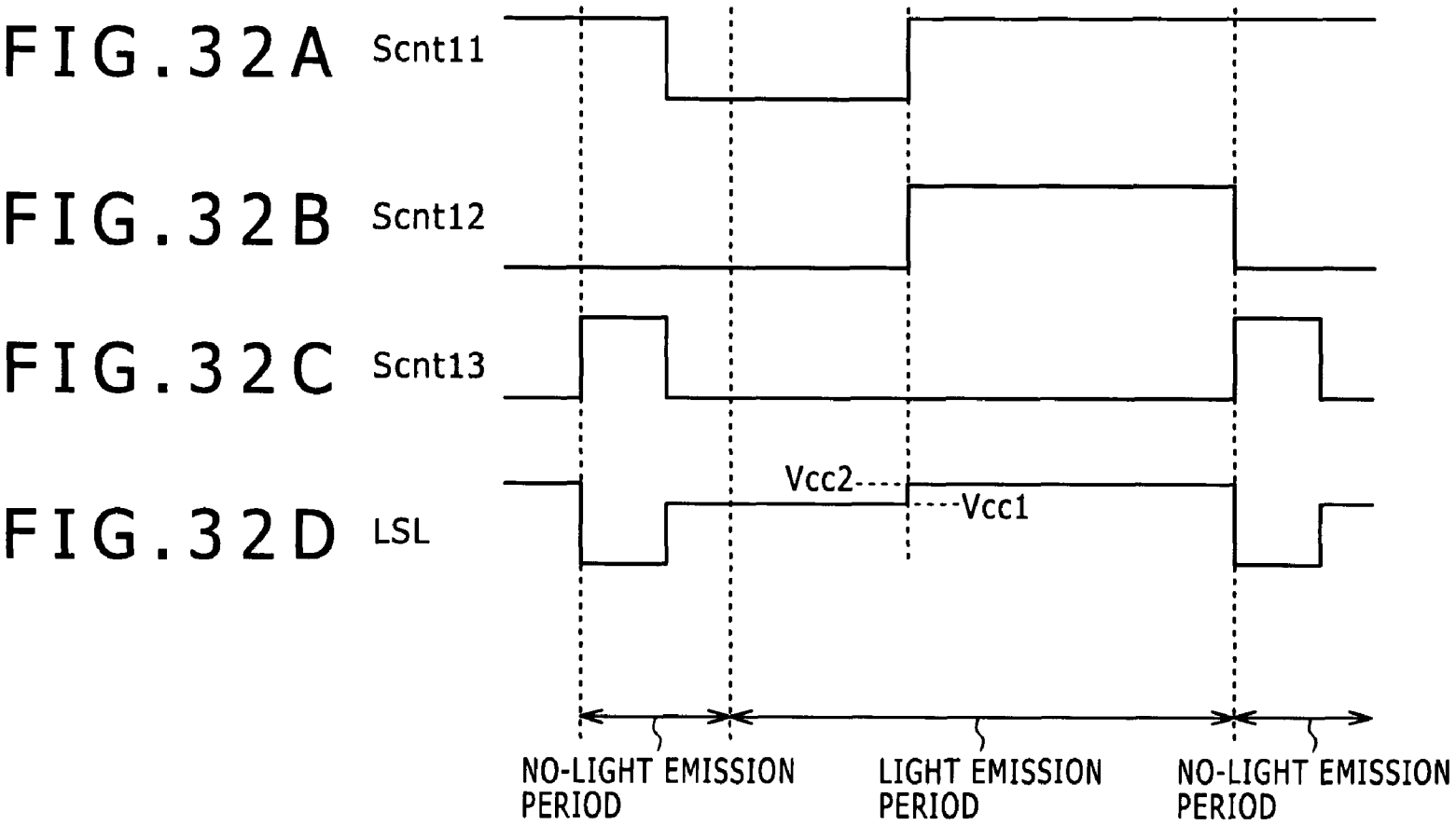
FIGS. 32A to 32D are explanatory timing diagrams showing relations between the waveforms of driving signals in the second control-line driving section and changes of electric potentials appearing on the lighting control signal line.

FIGS. 32A to 32D are explanatory timing charts showing relations between the waveforms of driving signals in the second control-line driving section 37 and operation periods of the pixel circuit. To be more specific, FIG. 32A is a timing chart showing the waveform of a driving signal asserted on the dedicated control signal line Scnt11 to serve as a signal for driving the gate electrode of the first P-channel thin-film transistor P31 whereas FIG. 32B is a timing chart showing the waveform of a driving signal asserted on the dedicated control signal line Scnt12 to serve as a signal for driving the gate electrode of the second P-channel thin-film transistor P32. FIG. 32C is a timing chart showing the waveform of a driving signal asserted on the dedicated control signal line Scnt13 to serve as a signal for driving the gate electrode of the N-channel thin-film transistor N31 whereas to FIG. 32D is a timing chart showing the waveform of an electric potential appearing on the lighting control signal line LSL.

In the case of the second control-line driving section 37 shown in the circuit diagram of FIG. 31, first of all, when the electric potential of the dedicated control signal line Scnt13 is set at the H level, the thin-film transistor N31 of the N-channel type is put in a turned-on state, controlling the electric potential appearing on the lighting control signal line LSL to the L level. Then, the electric potential of the dedicated control signal line Scnt13 is changed from the H level back to the L level. Interlocked with the operation to change the electric potential of the dedicated control signal line Scnt13, the electric potential of the dedicated control signal line Scnt11 is also changed from the H level to the L level in order to put the first thin-film transistor P31 of the P-channel type in a turned-on state outputting the first light emission electric potential Vcc1 to the lighting control signal line LSL. Subsequently, the electric potential of the dedicated control signal line Scnt13 is changed from the L level back to the H level. Interlocked with the operation to change the electric potential of the dedicated control signal line Scnt13, the electric potential of the dedicated control line Scnt12 is changed from the H level to the L level in order to put the second thin-film transistor P32 of the P-channel type in a turned-on state outputting the second light emission electric potential Vcc2 to the lighting control signal line LSL.

As a result, the electric potential appearing on the lighting control signal line LSL changes as shown in the timing chart of FIG. 32D in the same way as the electric potential appearing on the lighting control signal line LSL does as shown in the timing chart of FIG. 17C.

(D-2): Typical Configuration of the Pixel Circuit

In the case of the first and second embodiments described before, the number of thin-film transistors employed in the sub-pixel is two.

However, implementations of the sub-pixel are by no means limited to such a configuration. For example, the pixel-circuit may employ three or more thin-film transistors.

Figure 33:
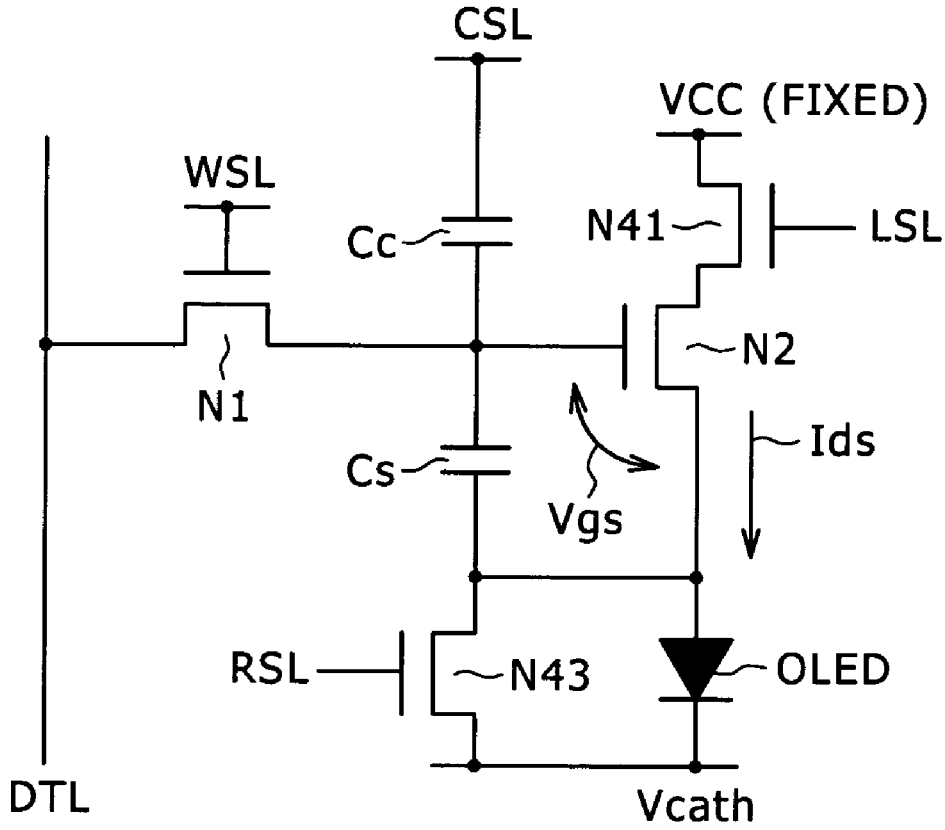
FIG. 33 is a circuit diagram showing another typical configuration of a sub-pixel.

FIG. 33 is a circuit diagram showing a typical configuration of a sub-pixel employing four thin-film transistors. It is to be noted that, in the circuit diagram of FIG. 33, components identical with their respective counterparts employed in the sub-pixel shown in the circuit diagram of FIG. 28 are denoted by the same reference numerals or the same reference notations as the counterparts. Three configuration changes are newly made in the sub-pixel shown in the circuit diagram of FIG. 33.

The first configuration change is the fact that the lighting control signal line LSL is replaced with a constant power-supply line VCC whereas the second configuration change is the fact that a lighting control transistor N41 is inserted between the constant power-supply line VCC and the device driving transistor N2, forming a series circuit in conjunction with the device driving transistor N2.

In the case of the sub-pixel shown in the circuit diagram of FIG. 33, the lighting control transistor N41 is a thin-film transistor of the N-channel type. The lighting control transistor N41 is controlled to enter a turned-on state or a turned-off state by the lighting control signal line LSL. With the lighting control transistor N41 put in a turned-on state, a driving power is supplied from the constant power-supply line VCC. With the lighting control transistor N41 put in a turned-off state, on the other hand, the operation to supply the driving power from the constant power-supply line VCC is terminated. The lighting control transistor N41 is controlled to enter a turned-off state by the lighting control signal line LSL during a no-light emission period and during a light extinction period (or a light turned-off period) in a light emission period.

The third configuration change is the fact that a reset transistor N43 is connected in parallel to the organic EL device OLED. The reset transistor N43 is also a thin-film transistor of the N-channel type. The reset transistor N43 is controlled to enter a turned-on state or a turned-off state by a reset control line RSL. The reset transistor N43 is controlled to enter a turned-on state at the initialization time and to enter a turned-off state at other times.

Figures 34A, 34B, 34C, 34D, 34E, 34F, 34G:
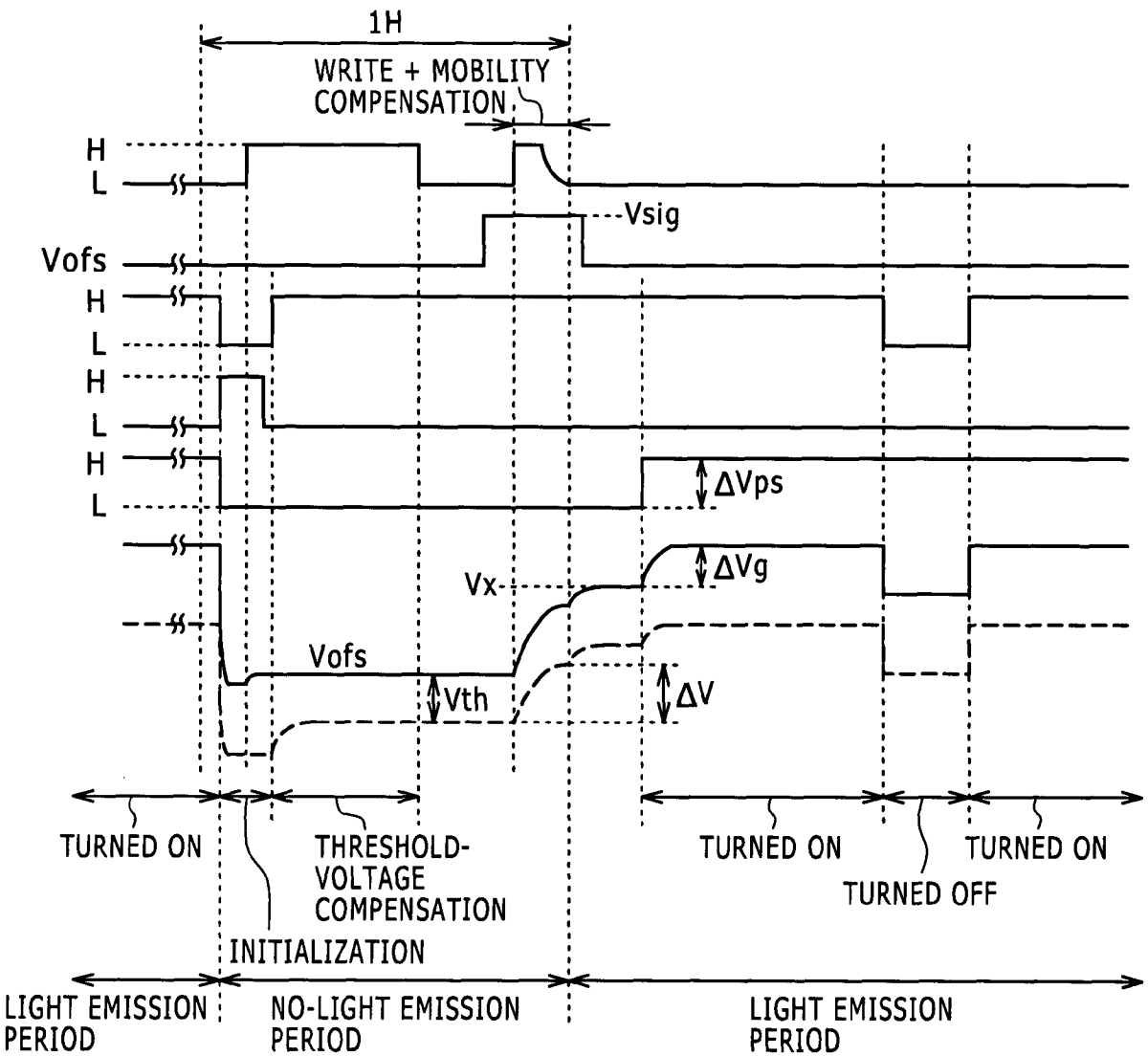
FIGS. 34A to 34G are timing diagrams showing typical changes of electric potentials inside the sub-pixel shown in the circuit diagram of FIG. 33.

FIGS. 34A to 34G are timing charts showing changes of electric potentials inside the sub-pixel shown in the circuit diagram of FIG. 33. To be more specific, FIG. 34A is a timing chart showing a waveform representing changes of a driving signal appearing on the write control signal line WSL whereas FIG. 34B is a timing chart showing a waveform representing changes of a driving signal appearing on the data signal line DTL. FIG. 34C is a timing chart showing a waveform representing changes of a driving signal appearing on the lighting control signal line LSL whereas FIG. 34D is a timing chart showing a waveform representing changes of a driving signal appearing on the reset control line RSL. FIG. 34E is a timing chart showing a waveform representing changes of a driving signal appearing on the coupling control signal line CSL. FIG. 34F is a timing chart showing a waveform representing changes of a gate electric potential Vg appearing at the gate electrode of the device driving transistor N2 whereas FIG. 34G is a timing chart showing a waveform representing changes of a source electric potential Vs appearing at the source electrode of the device driving transistor N2.

It is to be noted that the basic driving operations of the sub-pixel shown in the circuit diagram of FIG. 33 are the same as those according to the second embodiment. However, the basic driving operations of the sub-pixel shown in the circuit diagram of FIG. 33 include peculiar operations. The peculiar operations is an initialization process and an operation carried out to control the lighting control transistor N41 as an operation to connect the device driving transistor N2 to the constant power-supply line VCC or an operation to disconnect the device driving transistor N2 from the constant power-supply line VCC.

The following description explains the driving operations of the sub-pixel shown in the circuit diagram of FIG. 33 by focusing the explanation on differences from the second embodiment. In the initialization process, the lighting control transistor N41 is controlled to enter a turned-off state whereas the reset transistor N43 is controlled to enter a turned-on state. A specific one of the two electrodes of the signal holding capacitor Cs is connected to a line conveying the ground electric potential VSS so that electric charge accumulated in the signal holding capacitor Cs is drawn by the line conveying the ground electric potential VSS in a process referred to as the initialization process.

At the end of the initialization process, the lighting control transistor N41 is controlled to enter a turned-on state whereas the reset transistor N43 is controlled to enter a turned-off state. An equivalent circuit representing the state of the sub-pixel shown in the circuit diagram of FIG. 33 thereafter is the same as that of the sub-pixel shown in FIG. 28.

Thus, operations to drive the control lines are the same as the operations carried out to drive the control lines in accordance with the second embodiment.

(D-3): Another Typical Configuration of the Signal-Line Driving Section

In accordance with the description of the first embodiment, the digital-to-analog conversion circuit 45 employed in the signal-line driving section 33 reduces the signal amplitude to a value smaller than that of the ordinary driving method by a degree corresponding to an electric-potential increase produced by the coupling operation based on a coupling effect. However, the configuration of the signal-line driving section 5 available generally at the present day can be used as the configuration of the signal-line driving section 33 as it is.

(D-4): Other Pulse Waveforms in the Mobility Compensation Process

In the case of the embodiments described above, the falling waveform of the control pulse requesting the execution of the mobility compensation process is constructed to match the mobility compensation curve.

In the actual driving circuit, however, it is commonly known that the falling waveform of a control pulse appearing on the write control signal line WSL has a lack of sharpness even if the input control pulse applied to the write control signal line WSL has a rectangular waveform. For this reason, the input control pulse applied to the write control signal line WSL may have a rectangular waveform if the control pulse appearing on the write control signal line WSL has such a lack of sharpness that the falling waveform of the control pulse conforms to the mobility compensation curve.

(D-5): Product Examples (a): Electronic Apparatus

The description given so far has explained organic EL panel modules. The organic EL panel modules are also made available in the market as commercial products implemented in a variety of electronic apparatus. The following description explains typical implementations of the organic EL panel modules in some of the electronic apparatus.

Figure 35:
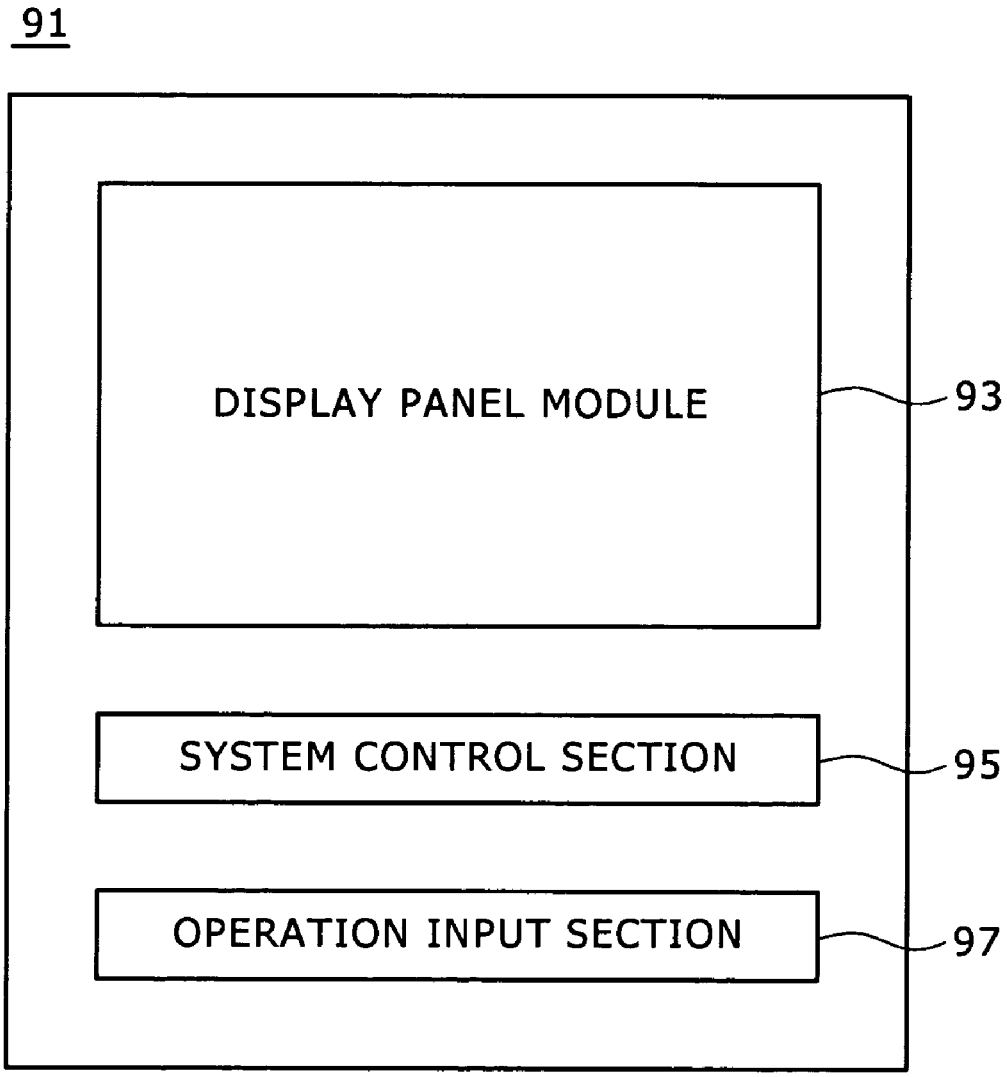
FIG. 35 is a block diagram showing a typical conceptual configuration of an electronic apparatus.

FIG. 35 is a block diagram showing a typical conceptual configuration of an electronic apparatus 91. As shown in the figure, the electronic apparatus 91 employs a display panel module 93 including the driving circuits described so far, a system control section 95 and an operation input section 97. Processing carried out by the system control section 95 depends on the function of the electronic apparatus 91. The operation input section 97 is a section for receiving operation inputs entered by the user to the system control section 95. The operation input section 97 includes a mechanical interface and/or a graphic interface. Typical examples of the mechanical interface are switches and buttons.

Figure 36:
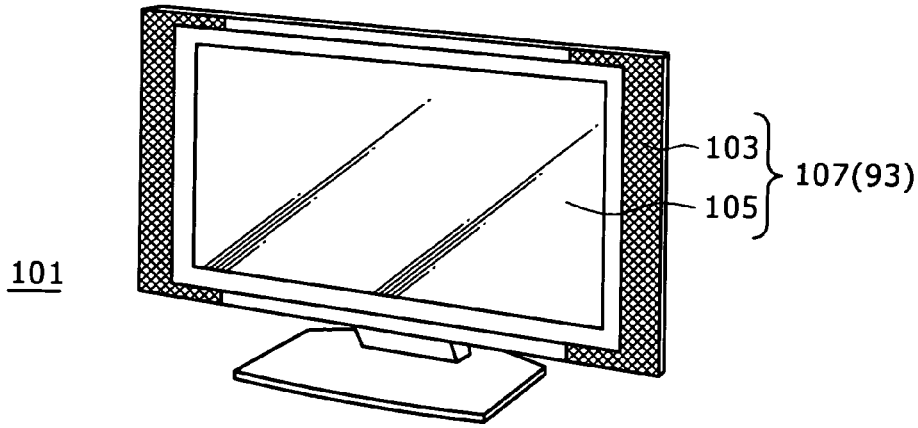
FIGS. 36 to 40 are diagrams each showing exemplary commercial products of the electronic apparatus.

FIG. 36 is a diagram showing a typical external view of an electronic apparatus 91 which functions as a TV receiver 101. The case front face of the TV receiver 101 includes a display screen 107 which has a front panel 103 and a filter glass 105. The display screen 107 corresponds to the display panel module 93 shown in the block diagram of FIG. 35.

Figure 37A:
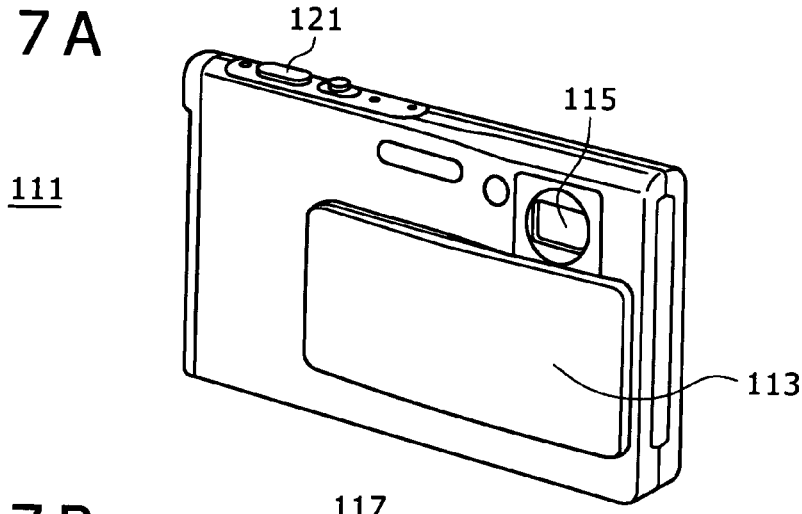
Figure 37B:
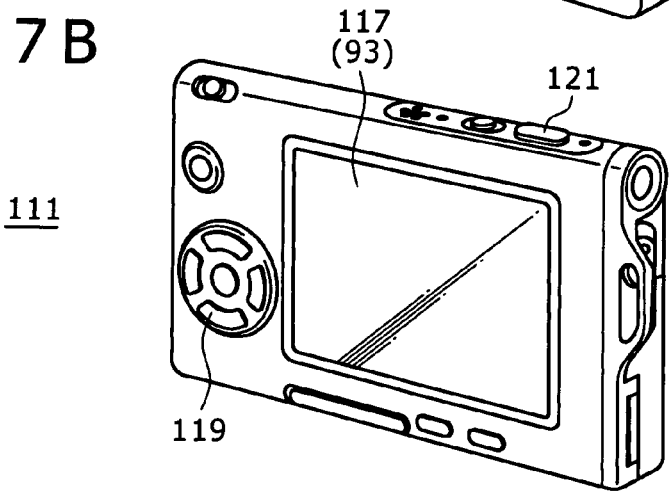

In addition, the electronic apparatus 91 may also be assumed to be a digital camera 111. FIGS. 37A and 37B are diagrams each showing a typical external view of the digital camera 111. To be more specific, FIG. 37A is a diagram showing a typical external view of the front side (or the subject side) of the digital camera 111 whereas FIG. 37B is a diagram showing a typical external view of the rear side (or the photographer side) of the digital camera 111.

As shown in the figures, the digital camera 111 employs a protection cover 113, a photographing lens 115, a display screen 117, a control switch 119 and a shutter button 121. The display screen 117 corresponds to the display panel module 93 shown in the block diagram of FIG. 35.

Figure 38:
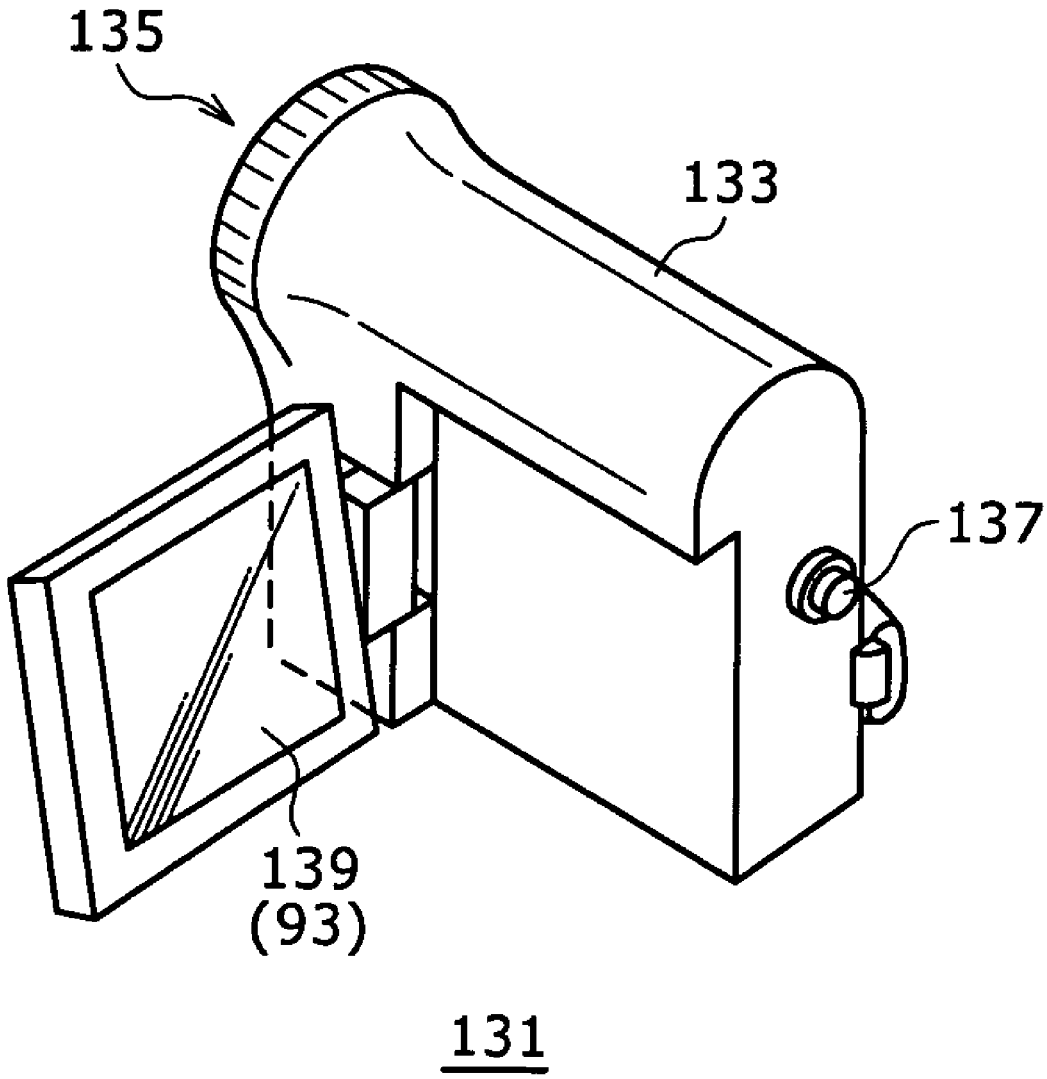

In addition, the electronic apparatus 91 may also be assumed to be a video camera 131. FIG. 38 is a diagram showing a typical external view of the video camera 131.

As shown in the figure, the video camera 131 includes a main unit 133, an image-taking lens 135, a photographing start/stop switch 137 and a display screen 139. The image-taking lens 135 is provided on the main unit 133 to serve as a lens for taking an image of a subject of video photographing. The display screen 139 corresponds to the display panel module 93 shown in the block diagram of FIG. 35.

Figure 39A:
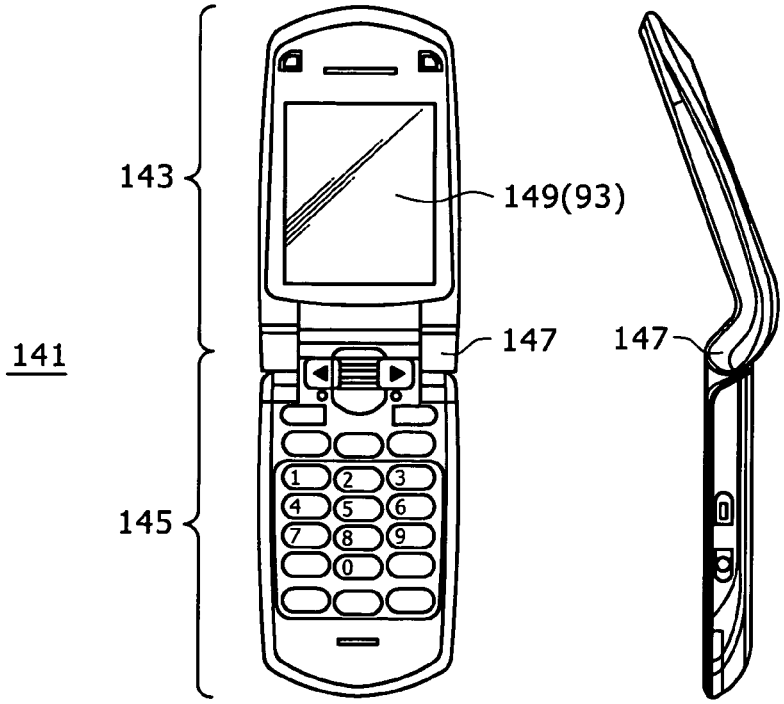
Figure 39B:
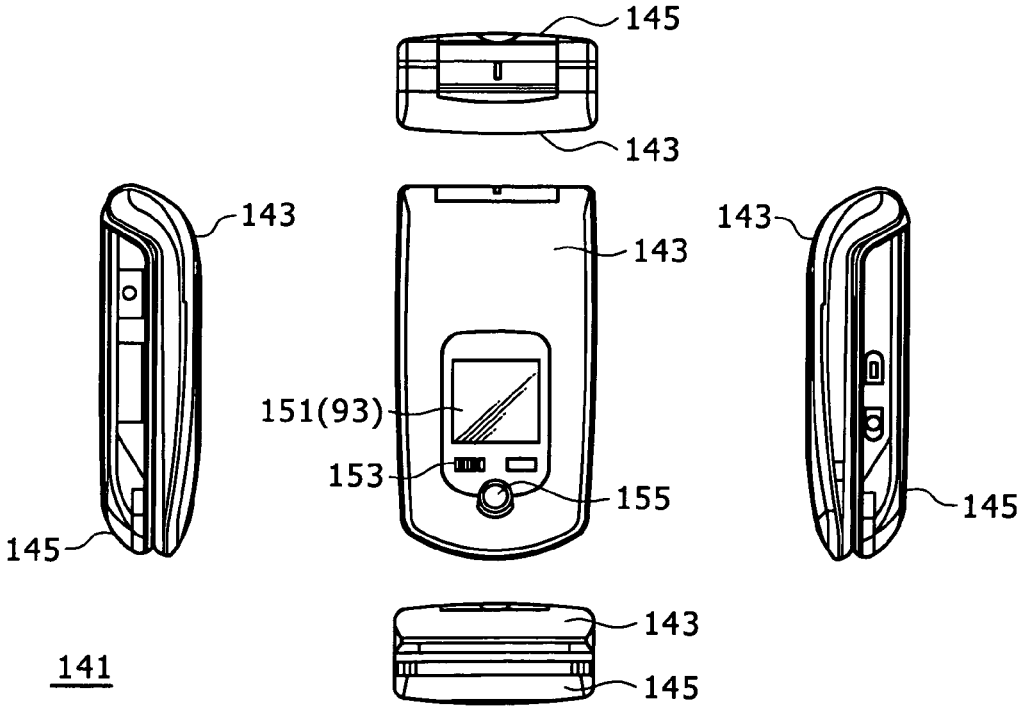

In addition, the electronic apparatus 91 may also be assumed to be a portable terminal. FIGS. 39A and 39B are diagrams each showing a typical external view of the portable terminal which serves as a cellular phone 141 of a fold-back type. To be more specific, FIG. 39A is a diagram showing a typical external view of the cellular phone 141 with a case thereof opened whereas FIG. 39B is a diagram showing a typical external view of the cellular phone 141 with the case folded back.

As shown in the figures, the cellular phone 141 employs an upper case 143, a lower case 145, a link section 147, a display screen 149, an auxiliary display screen 151, a picture light 153 and an image taking lens 155. In the case of this cellular phone 141, the link section 147 is a hinge. The display screen 149 and the auxiliary display screen 151 correspond to the display panel module 93 shown in the block diagram of FIG. 35.

Figure 40:
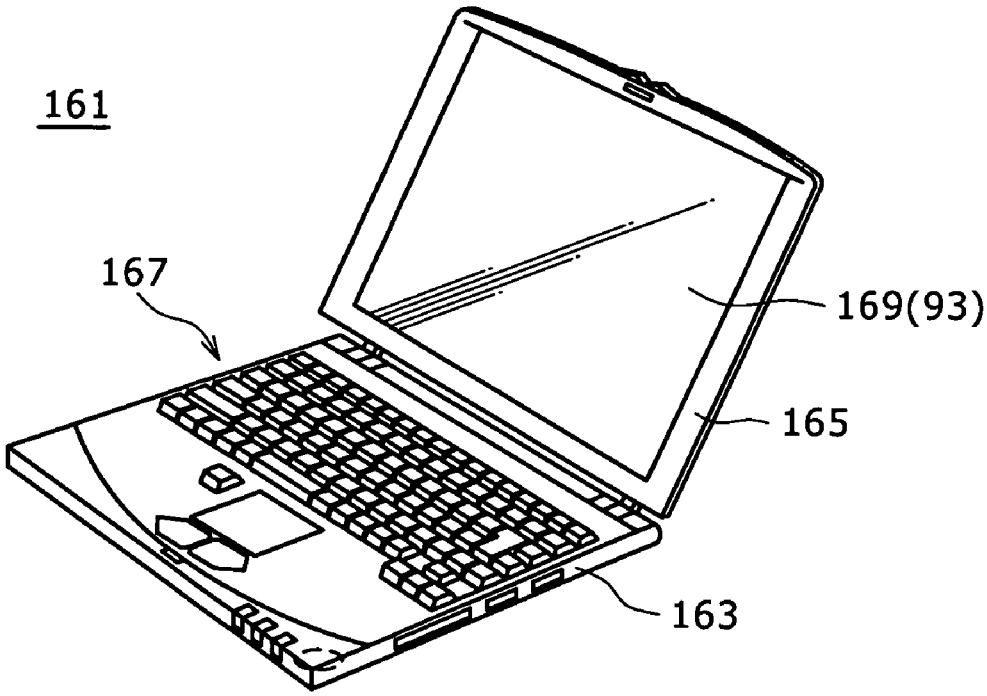

In addition, the electronic apparatus 91 may also be assumed to be a computer. FIG. 40 is a diagram showing a typical external view of the computer which is implemented as a notebook computer 161.

As shown in the figure, the notebook computer 161 employs an upper case 165, a lower case 163, a keyboard 167 and a display screen 169. The display screen 169 corresponds to the display panel module 93 shown in the block diagram of FIG. 35.

In addition, the electronic apparatus 91 may also be assumed to be an apparatus other than the electronic apparatus described above. Typical examples of the other electronic apparatus are an audio reproduction apparatus, a game machine, an electronic notebook and an electronic dictionary.

(D-6): Other Typical Display Devices

Each of the embodiments described above applies the present invention to an organic EL panel module.

However, the configuration of the signal and control line driving sections described above can be applied also to a display panel module of another light-emission type.

For example, the configuration of the signal and control line driving sections can be applied also to a display apparatus employing LEDs (Light Emitting Diode) laid out to form a 2-dimensional matrix. In addition, the configuration of the signal and control line driving sections can be applied also to a display panel module employing light emitting devices laid out on the display screen as devices each having a diode structure. On top of that, the configuration of the signal and control line driving sections can be applied also to an inorganic EL panel.

(D-7): Others

Each of the embodiments described above can be changed to a variety of conceivable modified versions within a range of essentials of the present invention. In addition, it is also possible to conceive a variety of changes/applications which are obtained by creations and/or combinations based on the descriptions in this specifications.

The present application contains subject matter related to that disclosed in Japanese Priority Patent Application JP 2008-205662 filed in the Japan Patent Office on Aug. 8, 2008, the entire content of which is hereby incorporated by reference.

What is claimed is:

1. A self-light-emission-type display panel module comprising:

a pixel array section including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

a first driving section configured to assert said signal electric potential on a data signal line;

a second driving section configured to assert an electric-potential write timing signal on a first control line connected to a control electrode of said signal sampling transistor; and a third driving section configured to provide a second control line connected to a second current electrode of said device driving transistor sequentially with the following three different driving voltages:

a first driving voltage having a lowest electric potential during a time span between the start of a no-light emission period and the start of a period for compensating said device driving transistor for characteristic variations, a second driving voltage having an intermediate electric potential during a time span between said start of said period for compensating said device driving transistor and an initial time of a light emission period, and a third driving voltage having a highest electric potential after said initial time of said light emission period.

2. The self-light-emission-type display panel module according to claim 1 wherein a period T used by said second driving section to assert said electric-potential write timing signal on said first control line for every pixel gradation is set at a value longer than a mobility compensation time t calculated for a signal electric potential corresponding to said pixel gradation.

3. The self-light-emission-type display panel module according to claim 2 wherein said mobility compensation time t is expressed by the following equation:

$$t=C/(k\cdot\mu\cdot Vsig)$$

where reference notation k denotes a constant, reference notation μ denotes the mobility of a thin-film transistor and reference notation Vsig denotes said signal electric potential corresponding to said pixel gradation.

4. A self-light-emission-type display panel module comprising:

a pixel array section including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, a signal sampling transistor for controlling an operation to supply a signal electric potential to said control electrode of said device driving transistor, and a coupling capacitor having a first electrode connected to said control electrode of said device driving transistor and a second electrode connected to a third control line;

a first driving section configured to assert said signal electric potential on a data signal line;

a second driving section configured to assert an electric-potential write timing signal on a first control line connected to a control electrode of said signal sampling transistor;

a third driving section configured to provide a second control line connected to a second current electrode of said device driving transistor sequentially with the following two different driving voltages a first driving voltage having a relatively low electric potential during a time span between the start of a no-light emission period and the start of a period for compensating said device driving transistor for characteristic variations, and a second driving voltage having a relatively high electric potential after said start of said period for compensating said device driving transistor; and a fourth driving section configured to provide said third control line sequentially with the following two different driving voltages:

a low-level driving voltage having a relatively low electric potential during a time span between said start of said no-light emission period and an initial time of a light emission period, and a high-level driving voltage having a relatively high electric potential after said initial time of said light emission period.

5. The self-light-emission-type display panel module according to claim 4 wherein a period T used by said second driving section to assert said electric-potential write timing signal on said first control line for every pixel gradation is set at a value longer than a mobility compensation time t calculated for a signal electric potential corresponding to said pixel gradation.

6. The self-light-emission-type display panel module according to claim 5 wherein said mobility compensation time t is expressed by the following equation:

$$t=C/(k\cdot\mu\cdot Vsig)$$

where reference notation k denotes a constant, reference notation μ denotes the mobility of a thin-film transistor and reference notation Vsig denotes said signal electric potential corresponding to said pixel gradation.

7. A self-light-emission-type display panel module comprising:

a pixel array section including pixel areas laid out to form a 2-dimensional matrix in a display area to serve as pixel areas each having at least a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

a first driving section configured to assert said signal electric potential on a data signal line;

a second driving section configured to assert an electric-potential write timing signal on a first control line connected to a control electrode of said signal sampling transistor; and a third driving section configured to increase an electric potential appearing at said control electrode of said device driving transistor through a coupling effect exercised after an initial time of a light emission period.

8. An electronic apparatus comprising:

a self-light-emission-type display panel module having a pixel array section including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor, a first driving section configured to assert said signal electric potential on a data signal line, a second driving section configured to assert an electric-potential write timing signal on a first control line connected to a control electrode of said signal sampling transistor, and a third driving section configured to provide a second control line connected to a second current electrode of said device driving transistor sequentially with the following three different driving voltages:

a first driving voltage having a lowest electric potential during a time span between the start of a no-light emission period and the start of a period for compensating said device driving transistor for characteristic variations, a second driving voltage having an intermediate electric potential during a time span between said start of said period for compensating said device driving transistor and an initial time of a light emission period, and a third driving voltage having a highest electric potential after said initial time of said light emission period;

a system control section configured to control operations of an entire system of said electronic apparatus; and an operation input section configured to receive operation inputs entered to said system control section.

9. An electronic apparatus comprising:

a self-light-emission-type display panel module having a pixel array section including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, a signal sampling transistor for controlling an operation to supply a signal electric potential to said control electrode of said device driving transistor, and a coupling capacitor having a first electrode connected to said control electrode of said device driving transistor and a second electrode connected to a third control line, a first driving section for asserting said signal electric potential on a data signal line, a second driving section configured to assert an electric-potential write timing signal on a first control line connected to a control electrode of said signal sampling transistor, a third driving section configured to provide a second control line connected to a second current electrode of said device driving transistor sequentially with the following two different driving voltages a first driving voltage having a relatively low electric potential during a time span between the start of a no-light emission period and the start of a period for compensating said device driving transistor for characteristic variations, and a second driving voltage having a relatively high electric potential after said start of said period for compensating said device driving transistor, and a fourth driving section configured to provide said third control line sequentially with the following two different driving voltages a low-level driving voltage having a relatively low electric potential during a time span between said start of said no-light emission period and an initial time of a light emission period, and a high-level driving voltage having a relatively high electric potential after said initial time of said light emission period;

a system control section configured to control operations of an entire system of said electronic apparatus; and an operation input section configured to receive operation inputs entered to said system control section.

10. An electronic apparatus comprising:

a self-light-emission-type display panel module having a pixel array section including pixel areas laid out to form a 2-dimensional matrix in a display area to serve as pixel areas each having at least a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor, a first driving section configured to assert said signal electric potential on a data signal line, a second driving section configured to assert an electric-potential write timing signal on a first control line connected to a control electrode of said signal sampling transistor, and a third driving section configured to increase an electric potential appearing at said control electrode of said device driving transistor through a coupling effect exercised after an initial time of a light emission period;

a system control section configured to control operations of an entire system of said electronic apparatus; and an operation input section configured to receive operation inputs entered to said system control section.

11. A self-light-emission-type display panel module comprising:

pixel array means including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

first driving means for assert said signal electric potential on a data signal line;

second driving means for asserting an electric-potential write timing signal on a first control line connected to a control electrode of said signal sampling transistor; and third driving means for providing a second control line connected to a second current electrode of said device driving transistor sequentially with the following three different driving voltages:

a first driving voltage having a lowest electric potential during a time span between the start of a no-light emission period and the start of a period for compensating said device driving transistor for characteristic variations, a second driving voltage having an intermediate electric potential during a time span between said start of said period for compensating said device driving transistor and an initial time of a light emission period, and a third driving voltage having a highest electric potential after said initial time of said light emission period.

12. A self-light-emission-type display panel module comprising:

pixel array means including pixel areas laid out to form a 2-dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, a signal sampling transistor for controlling an operation to supply a signal electric potential to said control electrode of said device driving transistor, and a coupling capacitor having a first electrode connected to said control electrode of said device driving transistor and a second electrode connected to a third control line;

first driving means for asserting said signal electric potential on a data signal line;

second driving means for asserting an electric-potential write timing signal on a first control line connected to a control electrode of said signal sampling transistor;

third driving means for providing a second control line connected to a second current electrode of said device driving transistor sequentially with the following two different driving voltages:

a first driving voltage having a relatively low electric potential during a time span between the start of a no-light emission period and the start of a period for compensating said device driving transistor for characteristic variations, and a second driving voltage having a relatively high electric potential after said start of said period for compensating said device driving transistor; and fourth driving means for providing said third control line sequentially with the following two different driving voltages a low-level driving voltage having a relatively low electric potential during a time span between said start of said no-light emission period and an initial time of a light emission period, and a high-level driving voltage having a relatively high electric potential after said initial time of said light emission period.

13. A self-light-emission-type display panel module comprising:

pixel array means including pixel areas laid out to form a 2-dimensional matrix in a display area to serve as pixel areas each having at least a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

first driving means for asserting said signal electric potential on a data signal line;

second driving means for asserting an electric-potential write timing signal on a first control line connected to a control electrode of said signal sampling transistor; and third driving means for increasing an electric potential appearing at said control electrode of said device driving transistor through a coupling effect exercised after an initial time of a light emission period.

* * * * *